US011302273B2

(12) United States Patent
Lim et al.

(10) Patent No.: US 11,302,273 B2
(45) Date of Patent: Apr. 12, 2022

(54) DISPLAY APPARATUS

(71) Applicant: SAMSUNG ELECTRONICS CO., LTD., Suwon-si (KR)

(72) Inventors: Sung-Jin Lim, Suwon-si (KR); Ji Hye Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 74 days.

(21) Appl. No.: 16/646,780

(22) PCT Filed: Aug. 9, 2018

(86) PCT No.: PCT/KR2018/009082
§ 371 (c)(1),
(2) Date: Mar. 12, 2020

(87) PCT Pub. No.: WO2019/054640
PCT Pub. Date: Mar. 21, 2019

(65) Prior Publication Data

US 2020/0294457 A1 Sep. 17, 2020

(30) Foreign Application Priority Data

Sep. 12, 2017 (KR) ..... 10-2017-0116536

(51) Int. Cl.
*G09G 5/00* (2006.01)
*G09G 3/36* (2006.01)

(52) U.S. Cl.
CPC ... *G09G 3/3614* (2013.01); *G09G 2300/0823* (2013.01); *G09G 2310/0297* (2013.01)

(58) Field of Classification Search
None
See application file for complete search history.

(56) References Cited

U.S. PATENT DOCUMENTS

2010/0176747 A1* 7/2010 Huang ..... G09G 3/3688 315/307
2010/0259523 A1* 10/2010 Huang ..... G09G 3/3688 345/211

(Continued)

FOREIGN PATENT DOCUMENTS

JP 2011-090151 5/2011
JP 2011-209452 10/2011

(Continued)

OTHER PUBLICATIONS

International Search Report for PCT/KR2018/009082, dated Nov. 16, 2018, 4 pages.

(Continued)

*Primary Examiner* — Carl Adams
(74) *Attorney, Agent, or Firm* — Nixon & Vanderhye, P.C.

(57) ABSTRACT

A display apparatus includes a liquid crystal panel; and a source driver configured to output an image signal to the liquid crystal panel. The source driver may include a digital-to-analog converter (DA converter) configured to convert digital image data into an image signal of normal polarity and an image signal of inversion polarity; a plurality of multiplexers each of which receives the image signal of the normal polarity and the image signal of the inversion polarity from the DA converter, and outputs the image signal of the normal polarity and the image signal of the inversion polarity as they are or cross outputs the image signal of the normal polarity and the image signal of the inversion polarity; and an inversion controller configured to output a control signal to each of the plurality of multiplexers through a plurality of output terminals respectively connected to the plurality of multiplexers. Each of the plurality of multiplexers may be configured to output the image signal of the normal polarity and the image signal of the inversion (Continued)

polarity as they are in response to a first control signal of the inversion controller, and to cross output the image signal of the normal polarity and the image signal of the inversion polarity in response to a second control signal of the inversion controller.

14 Claims, 16 Drawing Sheets

(56) References Cited

U.S. PATENT DOCUMENTS

| | | | | |
|---|---|---|---|---|
| 2015/0279293 | A1* | 10/2015 | Missbach | G09G 3/3614 345/94 |
| 2019/0189069 | A1* | 6/2019 | Huang | G09G 3/3614 |

FOREIGN PATENT DOCUMENTS

| | | |
|---|---|---|
| KR | 10-2008-0105288 | 12/2008 |
| KR | 10-2013-0119675 | 11/2013 |
| KR | 10-2016-0067261 | 6/2016 |

OTHER PUBLICATIONS

Written Opinion of the ISA for PCT/KR2018/009082, dated Nov. 16, 2018, 5 pages.

Notice of Preliminary Rejection dated Dec. 15, 2021 in Korean Application No. 10-2017-0116536 and English-language translation.

* cited by examiner

DISPLAY APPARATUS

This application is the U.S. national phase of International Application No. PCT/KR2018/009082 filed 9 Aug. 2018, which designated the U.S. and claims priority to KR Patent Application No. 10-2017-0116536 filed 12 Sep. 2017, the entire contents of each of which are hereby incorporated by reference.

Field

The present disclosure relates to a display apparatus, and more particularly, to a display apparatus including a liquid crystal panel.

Description of Related Art

In the related art, display apparatuses refer to output apparatuses displaying visual information converted from acquired or stored image information to users and have been widely used in various application fields such as individual homes or places of business.

For example, the display apparatuses may be monitor devices connected to personal computers or server computers, portable computer devices, navigation devices, televisions (TVs), Internet Protocol televisions (IPTVs), portable terminals, such as smart phones, tablet personal computers (PCs), personal digital assistants (PDAs), or cellular phones, or various display apparatuses used to play advertisements or movies in the industrial field, or various types of audio/video systems.

The display apparatuses may display an image using various types of display panels. For example, the display apparatuses may include a cathode ray tube panel, a light emitting diode (LED) panel, an organic light emitting diode (OLED) panel, a liquid crystal display (LCD) panel, and the like.

Summary

The present invention provides a display apparatus including a display driver capable of reversal-driving a liquid crystal panel in various patterns.

An aspect of the disclosure provides a display apparatus including: a liquid crystal panel; and a source driver configured to output an image signal to the liquid crystal panel. The source driver may include a digital-to-analog converter (DA converter) configured to convert digital image data into an image signal of normal polarity and an image signal of inversion polarity; a plurality of multiplexers each of which receives the image signal of the normal polarity and the image signal of the inversion polarity from the DA converter, and outputs the image signal of the normal polarity and the image signal of the inversion polarity as they are or cross outputs the image signal of the normal polarity and the image signal of the inversion polarity; and an inversion controller configured to output a control signal to each of the plurality of multiplexers through a plurality of output terminals respectively connected to the plurality of multiplexers. Each of the plurality of multiplexers may be configured to output the image signal of the normal polarity and the image signal of the inversion polarity as they are in response to a first control signal of the inversion controller, and to cross output the image signal of the normal polarity and the image signal of the inversion polarity in response to a second control signal of the inversion controller.

Each of the plurality of multiplexers may be configured to receive one of the first control signal and the second control signal from the inversion controller independently of each other.

The inversion controller may be configured to output different output signals to each of the multiplexers in different inversion modes of the source driver.

The source driver may be configured to operate in different inversion modes according to contents displayed on the liquid crystal panel.

The source driver may be configured to operate in different inversion modes according to any one of the first control signal and the second control signal supplied from the inversion controller to each of the plurality of multiplexers.

The source driver may be configured to operate in different inversion modes in a first frame and a second frame.

The display apparatus may further include a main controller configured to select an inversion mode according to the contents. The inversion controller may be configured to receive information about the selected inversion mode from the main controller, and to output any one of the first control signal and the second control signal to each of the plurality of multiplexers according to the information about the selected inversion mode.

The plurality of multiplexers may include first, second, third, and fourth multiplexers. The inversion controller may be configured to output the first control signal to each of the first, second, third, and fourth multiplexers. The first, second, third, and fourth multiplexers may be configured to output the image signal of the normal polarity and the image signal of the inversion polarity as they are.

The liquid crystal panel may include first and second subpixels connected to the first multiplexer, third and fourth subpixels connected to the second multiplexer, fifth and sixth subpixels connected to the third multiplexer, and seventh and eighth subpixels connected to the fourth multiplexer. The first, third, fifth, and seventh subpixels may be configured to receive the image signal of the normal polarity, and the second, fourth, sixth, and eighth subpixels are configured to receive the image signal of the inversion polarity.

The plurality of multiplexers may include first, second, third, and fourth multiplexers. The inversion controller may be configured to output the first control signal to the first and third multiplexers, and to output the second control signal to the second and fourth multiplexers. The first and third multiplexers may be configured to output the image signal of the normal polarity and the image signal of the inversion polarity as they are, and the second and fourth multiplexers are configured to cross output the image signal of the normal polarity and the image signal of the inversion polarity.

The liquid crystal panel may include first and second subpixels connected to the first multiplexer, third and fourth subpixels connected to the second multiplexer, fifth and sixth subpixels connected to the third multiplexer, and seventh and eighth subpixels connected to the fourth multiplexer. The first, fourth, fifth, and eighth subpixels may be configured to receive the image signal of the normal polarity, and the second, third, sixth, and seventh subpixels are configured to receive the image signal of the inversion polarity.

The plurality of multiplexers may include first, second, third, and fourth multiplexers. The inversion controller may be configured to output the first control signal to the first and second multiplexers, and to output the second control signal to the third and fourth multiplexers. The first and second multiplexers may be configured to output the image signal of the normal polarity and the image signal of the inversion polarity as they are, and the third and fourth multiplexers are configured to cross output the image signal of the normal polarity and the image signal of the inversion polarity.

The liquid crystal panel may include first and second subpixels connected to the first multiplexer, third and fourth subpixels connected to the second multiplexer, fifth and sixth subpixels connected to the third multiplexer, and seventh and eighth subpixels connected to the fourth multiplexer. The first, third, sixth, and eighth subpixels may be configured to receive the image signal of the normal polarity, and the second, fourth, fifth, and seventh subpixels are configured to receive the image signal of the inversion polarity.

The plurality of multiplexers may include first, second, third, and fourth multiplexers. The inversion controller may be configured to output the first control signal to the first and fourth multiplexers, and to output the second control signal to the second and third multiplexers. The first and fourth multiplexers may be configured to output the image signal of the normal polarity and the image signal of the inversion polarity as they are. The second and third multiplexers may be configured to cross output the image signal of the normal polarity and the image signal of the inversion polarity.

The liquid crystal panel may include first and second subpixels connected to the first multiplexer, third and fourth subpixels connected to the second multiplexer, fifth and sixth subpixels connected to the third multiplexer, and seventh and eighth subpixels connected to the fourth multiplexer. The first, fourth, sixth, and seventh subpixels may be configured to receive the image signal of the normal polarity, and the second, third, fifth, and eighth subpixels are configured to receive the image signal of the inversion polarity.

Another aspect of the disclosure provides a display apparatus including: a liquid crystal panel including a plurality of pixels; a receiver configured to receive a plurality of digital image data for the plurality of pixels; a plurality of normal DA converters configured to convert a portion of the plurality of digital image data received by the receiver into a normal polarity analog image signal; a plurality of inverted DA converters configured to convert another portion of the plurality of digital image data received by the receiver into an inversion polarity analog image signal; a plurality of multiplexers configured to output the normal polarity analog image signal and the inversion polarity analog image signal to the liquid crystal panel as they are, or cross output the normal polarity analog image signal and the inversion polarity analog image signal to the liquid crystal panel; and an inversion controller configured to output one of a first control signal and a second control signal to each of the plurality of multiplexers. Each of the plurality of multiplexers may be configured to output the normal polarity analog image signal and the inversion polarity analog image signal to the liquid crystal panel as they are in response to the first control signal, and to cross output the normal polarity analog image signal and the inversion polarity analog image signal to the liquid crystal panel in response to the second control signal.

According to an aspect of an embodiment, there is provided a display apparatus including a display driver capable of reversal-driving a liquid crystal panel in various patterns.

DETAILED DESCRIPTION OF EXAMPLE EMBODIMENTS

Figure 1:
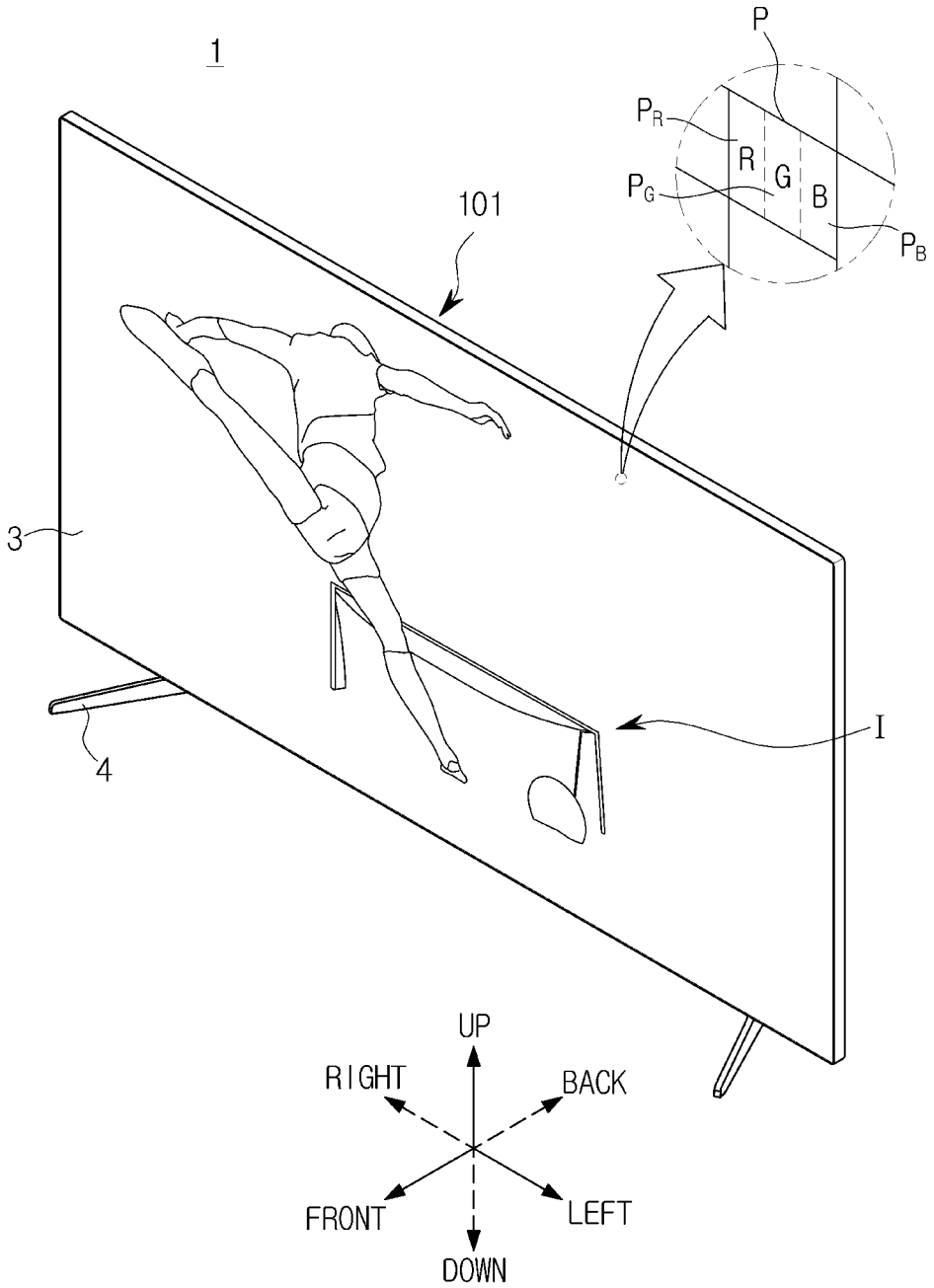
FIG. 1 is a view illustrating an appearance of a display apparatus according to an embodiment.

Like reference numerals refer to like elements throughout the specification. Not all elements of embodiments of the disclosure will be described, and description of what are commonly known in the art or what overlap each other in the embodiments will be omitted. The terms as used throughout the specification, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be understood that when an element is referred to as being "connected" to another element, it can be directly or indirectly connected to the other element, wherein the indirect connection includes "connection" via a wireless communication network.

Also, when a part "includes" or "comprises" an element, unless there is a particular description contrary thereto, the part may further include other elements, not excluding the other elements.

Further, when it is stated that a layer is "on" another layer or substrate, the layer may be directly on another layer or substrate or a third layer may be disposed therebetween.

It will be understood that, although the terms first, second, third, etc., may be used herein to describe various elements, it should not be limited by these terms. These terms are only used to distinguish one element from another element.

As used herein, the singular forms "a," "an" and "the" are intended to include the plural forms as well, unless the context clearly indicates otherwise.

An identification code is used for the convenience of the description but is not intended to illustrate the order of each step. Each of the steps may be implemented in an order different from the illustrated order unless the context clearly indicates otherwise.

Hereinafter, the operation principles and embodiments of the disclosure will be described with reference to the accompanying drawings.

FIG. 1 is a view illustrating an appearance of a display apparatus according to an embodiment.

A display apparatus 1 is an apparatus capable of processing an image signal received from the outside (e.g., external image source) and visually displaying the processed image. As shown in FIG. 1, the display apparatus 1 may be implemented as a TV, but the embodiment of the display apparatus 1 is not limited thereto. For example, the display apparatus 1 may be implemented as a monitor of a computer, or may be included in a navigation terminal device or various portable terminal devices. Here, the portable terminal devices may be a desktop computer, a laptop computer, a smartphone, a tablet personal computer (PC), a wearable computing device, or a personal digital assistant (PDA).

In addition, the display apparatus 1 may be a large format display (LFD) installed outdoors such as on a building roof or at a bus stop. The outdoors is not necessarily limited to the outside, but should be understood as a concept including a place where a large number of people can go in and out, even an area such as a subway station, a shopping mall, a movie theater, a company, a store, etc.

The display apparatus 1 may receive a video signal and an audio signal from various content sources, and may output video and audio corresponding to the video signal and the audio signal. For example, the display apparatus 1 may receive television broadcast content through a broadcast receiving antenna or a cable, receive content from a content reproduction device, or receive the content from a content providing server of a content provider.

The display apparatus 1 may include a main body 2, a screen 3 configured to display the image, a support 4 provided at a lower part of the main body 2 and configured to support the main body 2, and an input device 100 provided in the main body 2 and configured to operate the display apparatus 1.

The main body 2 may form an appearance of the display apparatus 1 and a component for displaying the image by the display apparatus 1 may be provided in the inside of the main body 2. The body shown in FIG. 1 may be in the form of a flat plate, but the shape of the main body 2 is not limited to that shown in FIG. 1. For example, the main body 2 may have a shape in which the left and right ends protrude forward and a center part is curved so as to be concave.

The screen 3 may be formed on the front surface of the main body 2, and the screen 3 may display the image as visual information. For example, a still image or a moving image may be displayed on the screen 3, and a two-dimensional plane image or a three-dimensional stereoscopic image may be displayed.

A plurality of pixels may be formed on the screen 3, and the image displayed on the screen 3 may be formed by a combination of light emitted from the plurality of pixels. For example, a single image I may be formed on the screen 3 by combining the light emitted by a plurality of pixels P with a mosaic.

Each of the plurality of pixels P may emit the light of various brightness and various colors.

Each of the plurality of pixels may include a configuration (for example, an organic light emitting diode) capable of emitting the light directly in order to emit the light of various brightness, or a configuration (for example, a liquid crystal panel) capable of transmitting or blocking the light emitted by a backlight unit or the like.

In order to emit the light of various colors, each of the plurality of pixels P may include subpixels PR, PG, and PB.

The subpixels PR, PG, and PB may emit light. The red subpixel PR may emit red light, the green subpixel PG may emit green light, and the blue subpixel PB may emit blue light. For example, red light may represent light from approximately 620 nm (nanometer) to 750 nm in wavelength, green light may represent light from approximately 495 nm to 570 nm, and blue light may represent light from approximately 450 nm to 495 nm.

By the combination of red light of the red subpixel PR, green light of the green subpixel PG, and blue light of the blue subpixel PB, each of the plurality of pixels P may emit the light of various brightness and various colors.

The screen 3 may be provided in a flat plate shape as illustrated in FIG. 1. However, the shape of the screen 3 is not limited to that shown in FIG. 1. It may be provided in a shape in which both ends protrude forward and the center portion is curved so as to be concave according to the shape of the main body 2.

The support 4 may be provided at the lower part of the main body 2 so that the main body 2 can stably maintain its position on a floor. Alternatively, the support 4 may be provided on the rear surface of the main body 2 so that the main body 2 is firmly fixed to a wall surface.

Figure 2:
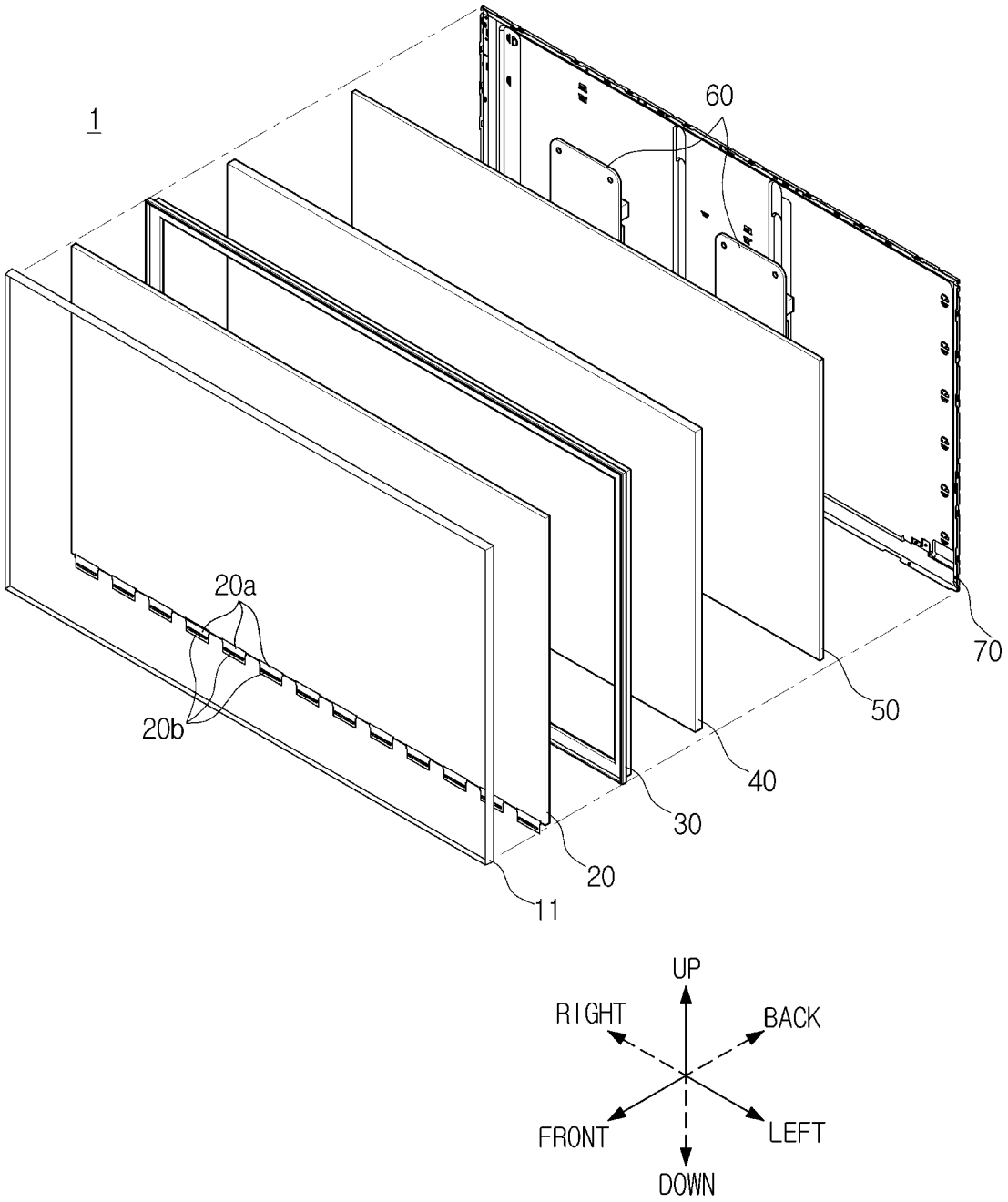
FIG. 2 is an exploded view illustrating a display apparatus according to an embodiment.
Figure 3:
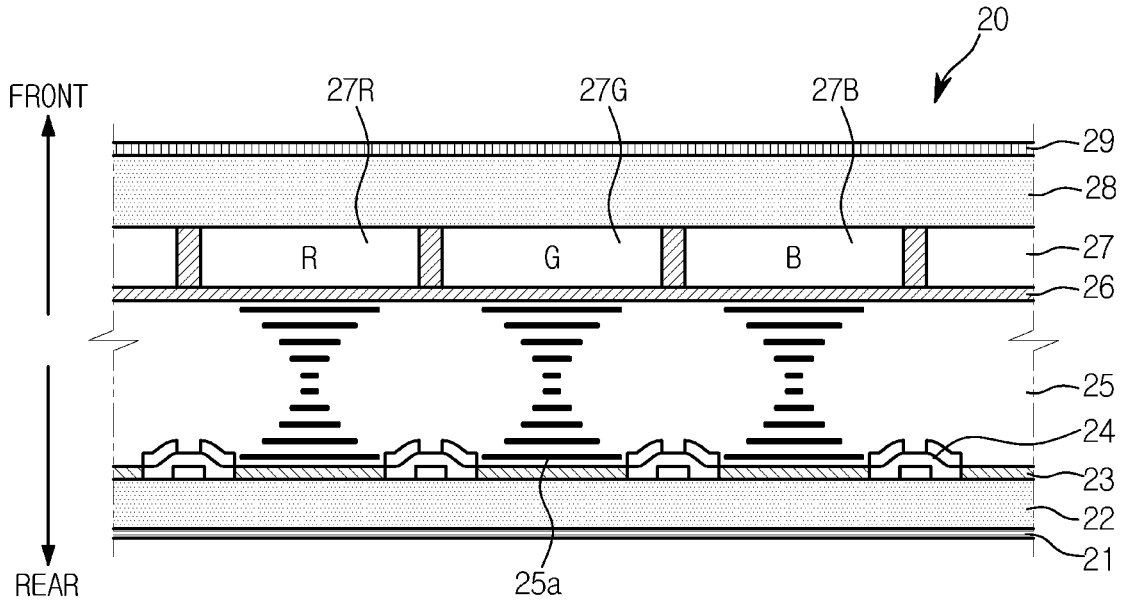
FIG. 3 is a view illustrating an example of a liquid crystal panel included in a display apparatus according to an embodiment.

FIG. 2 is an exploded view illustrating a display apparatus according to an embodiment, and FIG. 3 is a view illustrating an example of a liquid crystal panel included in a display apparatus according to an embodiment.

As illustrated in FIG. 2, various components for generating the image on the screen 3 may be provided in the main body 2.

For example, the main body 2 may include a backlight unit 40 configured to emit a surface light forward, a liquid crystal panel 20 configured to block or transmit the light emitted from the backlight unit 40, and a power supply/controller 60 configured to control operations of the backlight unit 40 and the liquid crystal panel 20. The main body 2 may further include a bezel 10, a frame middle mold 30, a bottom chassis 50, and a rear cover 70 for supporting and fixing the liquid crystal panel 20, the backlight unit 40, and the power supply/controller 60.

The backlight unit 40 may include a point light source for emitting monochromatic light or white light and may refract, reflect, and scatter the light to convert the light emitted from the point light source into a uniform surface light.

For example, the backlight unit 40 may include a light source for emitting the monochromatic light or white light, a light guide plate for diffusing the light incident from the light source, a reflective sheet for reflecting the light emitted from the rear surface of the light guide plate, and an optical sheet for refracting and scattering the light emitted from the front surface of the light guide plate.

As such, the backlight unit 40 may emit a uniform surface light source toward the front by refracting, reflecting, and scattering the light emitted from the light source.

The liquid crystal panel 20 may be provided in front of the backlight unit 40 and configured to block or transmit the light emitted from the backlight unit 40 in order to form the image.

The front surface of the liquid crystal panel 20 may form the screen 3 of the display apparatus 1 described above and may be composed of the plurality of pixels P. The plurality of pixels P included in the liquid crystal panel 20 may independently block or transmit the light of the backlight unit 40. The light transmitted by the plurality of pixels P may form the image to be displayed on the display apparatus 1.

Referring to FIG. 3, the liquid crystal panel 20 may include a first polarizing film 21, a first transparent substrate 22, a pixel electrode 23, a thin film transistor 24, a liquid crystal layer 25, a common electrode 26, a color filter 27, a second transparent substrate 28, and a second polarizing film 29.

The first transparent substrate 22 and the second transparent substrate 28 may support the pixel electrode 23, the thin film transistor 24, the liquid crystal layer 25, the common electrode 26, and the color filter 27 in a fixed manner. The first and second transparent substrates 22 and 28 may be composed of tempered glass or transparent resin.

The first polarizing film 21 and the second polarizing film 29 may be provided on the outer sides of the first and second transparent substrates 22 and 28.

The first polarizing film 21 and the second polarizing film 29 may transmit a specific light and block a different light, respectively.

The light may be a pair of an electric field and a magnetic field that oscillate in a direction perpendicular to a traveling direction. The electric field and the magnetic field constituting the light may oscillate in all directions perpendicular to the traveling direction of light, and the oscillation direction of the electric field and the oscillation direction of the magnetic field may be perpendicular to each other.

For example, the first polarizing film 21 may transmit the light having the magnetic field oscillating in a first direction and block other light. Further, the second polarizing film 29 may transmit the light having the magnetic field oscillating in a second direction and block other light. At this time, the first direction and the second direction may be perpendicular to each other. In other words, a polarizing direction of the light transmitted by the first polarizing film 21 and an oscillating direction of the light transmitted by the second polarizing film 29 may be perpendicular to each other. As a result, the light may not pass through the first polarizing film 21 and the second polarizing film 29 at the same time.

The color filter 27 may be provided in the inside of the second transparent substrate 28.

The color filter 27 may include a red filter 27R for transmitting a red light, a green filter 27G for transmitting a green light, and a blue filter 27B for transmitting a blue light. The red filter 27R, the green filter 27G, and the blue filter 27B may be arranged side by side.

A region in which the color filter 27 is formed may correspond to the pixel P described above. In addition, a region in which the red filter 27R is formed may correspond to the red subpixel PR, a region in which the green filter 27G is formed may correspond to the green subpixel PG, and a region in which the blue filter 27B is formed may correspond to the blue subpixel PB.

The thin film transistor (TFT) 24 may be provided in the inside of the first transparent substrate 22. For example, the thin film transistor 24 may be provided at a position corresponding to a boundary between the red filter 27R, the green filter 27G, and the blue filter 27B.

The thin film transistor 24 may transmit or block a current flowing to the pixel electrode 23 described below. For example, an electric field may be formed or removed between the pixel electrode 23 and the common electrode 26 according to the turning on (closing) or turning off (opening) of the thin film transistor 24.

The thin film transistor 24 may be formed of polysilicon or may be formed by a semiconductor process such as lithography, deposition, or ion implantation.

The pixel electrode 23 may be provided in the inside of the first transparent substrate 22 and the common electrode 26 may be provided in the inside of the second transparent substrate 28.

The pixel electrode 23 and the common electrode 26 may be composed of a conductive metal which electricity is conducted and may generate the electric field for changing the arrangement of liquid crystal molecules 25*a* constituting the liquid crystal layer 25 to be described below.

The pixel electrode 23 may be formed in a region corresponding to the red filter 27R, the green filter 27G and the blue filter 27B, and the common electrode 26 may be formed on the entire liquid crystal panel 20. As a result, the electric field may be selectively formed in the liquid crystal layer 25 according to the position of the pixel electrode 23.

The pixel electrode 23 and the common electrode 26 are composed of a transparent material and may transmit the light incident from the outside. For example, the pixel electrode 23 and the common electrode 26 may be composed of indium tin oxide (ITO), indium zinc oxide (IZO), silver nano wire, carbon nano tube (CNT), graphene, or PEDOT (3,4-ethylenedioxythiophene).

The liquid crystal layer 25 may be formed between the pixel electrode 23 and the common electrode 26, and the liquid crystal layer 25 may be filled with the liquid crystal molecules 25*a*.

The liquid crystal may represent an intermediate state between a solid (crystal) and a liquid. In general, when a solid material is heated, the state may change from a solid state to a transparent liquid state at a melting temperature. On the other hand, when heat is applied to a liquid crystal material in the solid state, the liquid crystal material may change to the transparent liquid state after being changed into an opaque and turbid liquid at the melting temperature. Most of these liquid crystal materials are organic compounds, and their molecular shapes have a long and narrow rod shape. The arrangement of the molecules is the same as an irregular state in any direction, but may have a regular crystal form in the other direction. As a result, the liquid crystal has both the fluidity of liquid and the optical anisotropy of crystal (solid).

The liquid crystal may also exhibit optical properties according to the change of the electric field. For example, the direction of the molecular arrangement of the liquid crystal may change according to the change of the electric field.

When an electric field is generated in the liquid crystal layer, the liquid crystal molecules 25*a* of the liquid crystal layer 25 may be arranged in the direction of the electric field. When no electric field is generated in the liquid crystal layer 25, the liquid crystal molecules 25*a* may be irregularly arranged or disposed along an alignment film (not shown).

As a result, the optical properties of the liquid crystal layer 25 may change according to the presence or absence of the electric field passing through the liquid crystal layer 25. For example, when an electric field is not formed in the liquid crystal layer 25, the light polarized by the first polarizing film 21 may pass through the second polarizing film 29 after passing through the liquid crystal layer 25 due to the arrangement of the liquid crystal molecules 25*a* of the liquid crystal layer 25. On the other hand, when an electric field is formed in the liquid crystal layer 25, the arrangement of the liquid crystal molecules 25*a* of the liquid crystal layer 25 changes so that the light polarized by the first polarizing film 21 may pass through the second polarizing film 29 after passing through the liquid crystal layer 25. On the other hand, when an electric field is formed in the liquid crystal layer 25, the arrangement of the liquid crystal molecules 25*a* of the liquid crystal layer 25 changes so that the light polarized by the first polarizing film 21 may not pass through the second polarizing film 29.

The power supply/controller 60 may include the backlight unit 40 and a power supply circuit for supplying a voltage to the liquid crystal panel 20 and a control circuit for controlling operations of the backlight unit 40 and the liquid crystal panel 20.

The power supply circuit may supply electric power to the backlight unit 40 so that the backlight unit 40 can emit the surface light and supply the electric power to the liquid crystal panel 20 so that the liquid crystal panel 20 can transmit or block the light.

The control circuit may control the backlight unit 40 to control the intensity of the light emitted by the backlight unit 40 and may control the liquid crystal panel 20 to display the image on the screen 3.

For example, the control circuit may control the liquid crystal panel 20 to display the image based on the video signal received from the content sources. Each of the plurality of pixels P included in the liquid crystal panel 20 may transmit or block the light according to image data of the control circuit, so that the image is displayed on the screen 3.

The power supply/controller 60 may be implemented as a printed circuit board and various circuits mounted on the printed circuit board. For example, the power supply circuit may include a capacitor, a coil, a resistance element, a microprocessor, and the like, and a power supply circuit board on which the power supply circuit is mounted. Further, the control circuit may include a memory, a microprocessor, and a control circuit board on which the control circuit is mounted.

Between the liquid crystal panel 20 and the power supply/controller 60, a cable 20*a* for transferring the image data from the power supply/controller 60 to the liquid crystal panel 20 and a display driver integrated circuit (DDI) 20*b* (hereinafter, referred to as 'display drive unit') for processing the image data may be provided.

The cable 20*a* may electrically connect the power supply/controller 60 and the display drive unit 20*b* and electrically connect the display drive unit 20*b* and the liquid crystal panel 20 to each other.

The display drive unit 20*b* may receive the image data from the power supply/controller 60 through the cable 20*a* and transmit the image data to the liquid crystal panel 20 through the cable 20*a*.

The cable 20*a* may be implemented as a film cable that can be bent by an external force, and the cable 20*a* and the display drive unit 20*b* may be integrally implemented as a film cable, a chip on film (COF), a tape carrier packet (TCP), or the like. In other words, the display drive unit 20*b* may be disposed on the cable 20*a*.

However, the present disclosure is not limited thereto, and the display drive unit 20*b* may be disposed on the first transparent substrate 22 of the liquid crystal panel 20.

Figure 4:
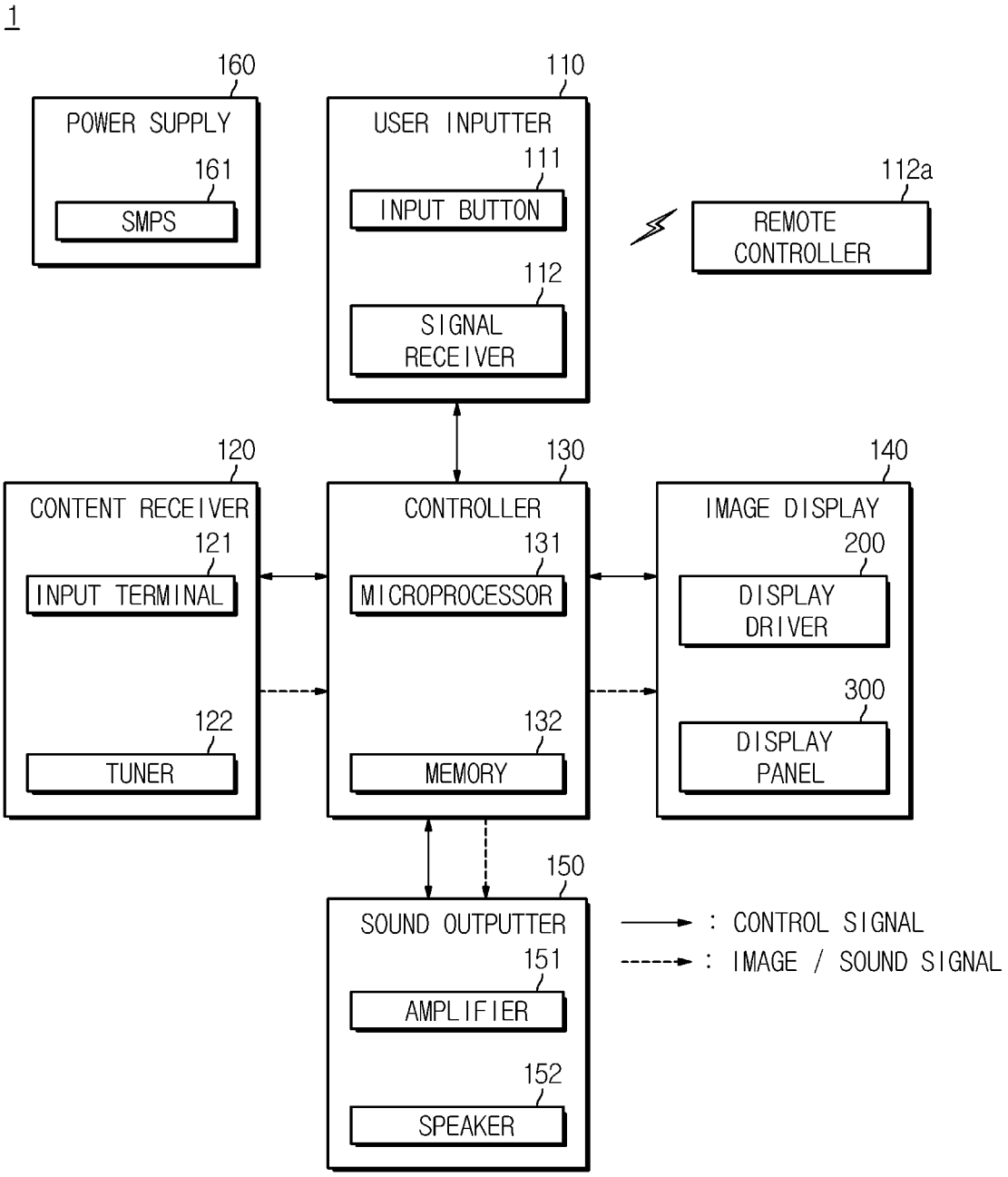
FIG. 4 is a view illustrating a control configuration of a display apparatus according to an embodiment.

FIG. 4 is a view illustrating a control configuration of a display apparatus according to an embodiment.

As illustrated in FIG. 4, the display apparatus 1 may include a user inputter 110 for receiving a user input from a user, a content receiver 120 for receiving a video signal and/or an audio signal from content sources, a controller 130 for processing the video signal and/or the audio signal received by the content receiver 120 and controlling an operation of the display apparatus 1, an image display 140 for displaying an image processed by the controller 130, a sound outputter 150 for outputting a sound processed by the controller 130, and a power supply 160 for supplying power to components of the display apparatus 1.

The user inputter 110 may include input buttons 111 for receiving the user input. For example, the user inputter 110 may include a power button for turning on or off the display apparatus 1 a channel selection button for selecting broadcast content displayed on the display apparatus 1, a sound control button for adjusting the volume of the sound output by the display apparatus 1, a source selection button for selecting the content source, and the like.

The input buttons 111 may each receive the user input and output an electrical signal corresponding to the user input to the controller 130. The input buttons 111 may be implemented by various input devices, such as a push switch, a touch switch, a dial, a slide switch, a toggle switch, and the like.

The user inputter 110 may also include a signal receiver 112 for receiving a remote control signal of a remote controller 112*a*. The remote controller 112*a* for receiving the user input may be provided separately from the display apparatus 1, and may receive the user input and transmit a radio signal corresponding to the user input to the display apparatus 1. The signal receiver 112 may receive the radio signal corresponding to the user input from the remote controller 112*a* and output an electrical signal corresponding to the user input to the controller 130.

The content receiver 120 may include input terminals 121 and a tuner 122 that receive the video signal and/or the audio signal from the content sources.

The input terminals 121 may receive the video signal and the audio signal from the content sources through the cable. In other words, the display apparatus 1 may receive a video signal and an audio signal from the content sources through the input terminals 121.

The input terminals 121 may be, for example, a component (component, YPbPr/RGB) terminal, a composite (composite video blanking and sync (CVBS)) terminal, an audio terminal, a high definition multimedia interface (HDMI) terminal, a universal serial bus (USB) terminal, and the like.

The tuner 122 may receive broadcast signals through the broadcast receiving antenna or the wired cable and extract a broadcast signal of a channel selected by the user from the broadcast signals. For example, the tuner 122 may pass a broadcast signal having a frequency corresponding to a channel selected by the user among a plurality of the broadcast signals received through the broadcast receiving antenna or the wired cable, and block the broadcast signals having other frequencies.

As such, the content receiver 120 may receive a video signal and an audio signal from the content sources through the input terminals 121 and/or the tuner 122, and may output the video signal and the audio signal received through the input terminals 121 and/or the tuner 122 to the controller 130.

The controller 130 may include a microprocessor 131 and a memory 132.

The memory 132 may store programs and data for controlling the display apparatus 1 and temporarily store the data generated while the display apparatus 1 is being controlled.

In addition, the memory 132 may store the programs and data for processing video signals and/or audio signals, and temporarily store the data generated during the processing of the video signals and/or audio signals.

The memory 132 may include a non-volatile memory such as ROM or a flash memory for storing the data for a long period of time, a volatile memory such as static random access memory (S-RAM) or dynamic random access memory (D-RAM) for temporarily storing the data.

The microprocessor 131 may receive the user input from the user inputter 110 and generate control signals for controlling the content receiver 120 and/or the image display 140 and/or the sound outputter 150 according to the user input.

In addition, the microprocessor 131 may receive the video signal and/or the audio signal from the content receiver 120, decode the video signal to generate image data, and decode the audio signal to generate sound data. The image data and the sound data may be output to the image display 140 and the sound outputter 150, respectively.

The microcontroller 131 may include the operation circuit to perform logic operations and arithmetic operations and the memory circuit to temporarily store computed data.

The controller 130 may control operations of the content receiver 120, the image display 140, and the sound outputter 150 according to the user input. For example, when the content source is selected by the user input, the controller 130 may control the content receiver 120 to receive the video signal and/or the audio signal from the selected content source.

In addition, the controller 130 may process the video signal and/or the audio signal received by the content receiver 120, and reproduce the image and the sound from the video signal and/or the audio signal. In detail, the controller 130 may decode the video signal and/or the audio signal, and may restore the image data and the sound data from the video signal and/or the audio signal.

The controller 130 may be implemented as the control circuit in the power supply/controller 60 described above with reference to FIGS. 2 and 3.

The image display 140 may include a display panel 300 for visually displaying an image and a display driver 200 for driving the display panel 300.

The display panel 300 may generate the image according to the image data received from the display driver 200, and display the image.

The display panel 300 may include a pixel serving as a unit for displaying the image. Each of the pixels may receive an electrical signal representative of the image from the display driver 200 and output an optical signal corresponding to the received electrical signal. As described above, the optical signals output by the plurality of pixels may be combined and displayed on the display panel 300.

The display panel 300 may be implemented with the liquid crystal panel 20 (see FIGS. 2 and 3) described with reference to FIGS. 2 and 3.

The display driver 200 may receive the image data from the controller 130 and may drive the display panel 300 to display the image corresponding to the received image data. Particularly, the display driver 200 may transmit the electrical signal corresponding to the image data to each of the plurality of pixels constituting the display panel 300.

When the display driver 200 transmits the electrical signal corresponding to the image data to each pixel constituting the display panel 300, each of the pixels may output the light corresponding to the received electrical signal, and the light output by each of the pixels may be combined to form a single image.

The display driver 200 may be implemented with the display drive unit 20*b* (see FIG. 2) described in conjunction with FIG. 2.

The sound outputter 150 may include an amplifier 151 for amplifying sound, and a speaker 152 for audibly outputting the amplified sound.

The controller 130 may convert sound data decoded from the audio signal into an analog sound signal, and the amplifier 151 may amplify the analog sound signal output from the controller 130.

The speaker 152 may convert the analog sound signal amplified by the amplifier 151 into an audible sound. For example, the speaker 152 may include a thin film that vibrates according to an electrical sound signal, and sound waves may be generated by the vibration of the thin film.

The power supply 160 may supply power to the user inputter 110, the content receiver 120, the controller 130, the image display 140, the sound outputter 150, and all the other components.

The power supply 160 may include a switching mode power supply 161 (hereinafter, referred to as 'SMPS').

The SMPS 161 may include an AC-DC converter for converting alternating current (AC) power of an external power source to direct current (DC) power, and a DC-DC converter for changing a voltage of DC power. For example, the AC power of an external power source may be converted into DC power by the AC-DC converter, and the voltage of the DC power may be changed into various voltages (for example, 5V and/or 15V) by the DC-DC converter. The DC power whose voltage is changed may be supplied to the user inputter 110, the content receiver 120, the controller 130, the image display 140, the sound outputter 150, and all the other components, respectively.

As described above, the controller 130 may process the video signal to output the image data to the image display 140, and the display driver 200 of the image display 140 may drive the display panel according to the image data.

Hereinafter, the configuration and operation of the display driver 200 will be described in more detail.

Figure 5:
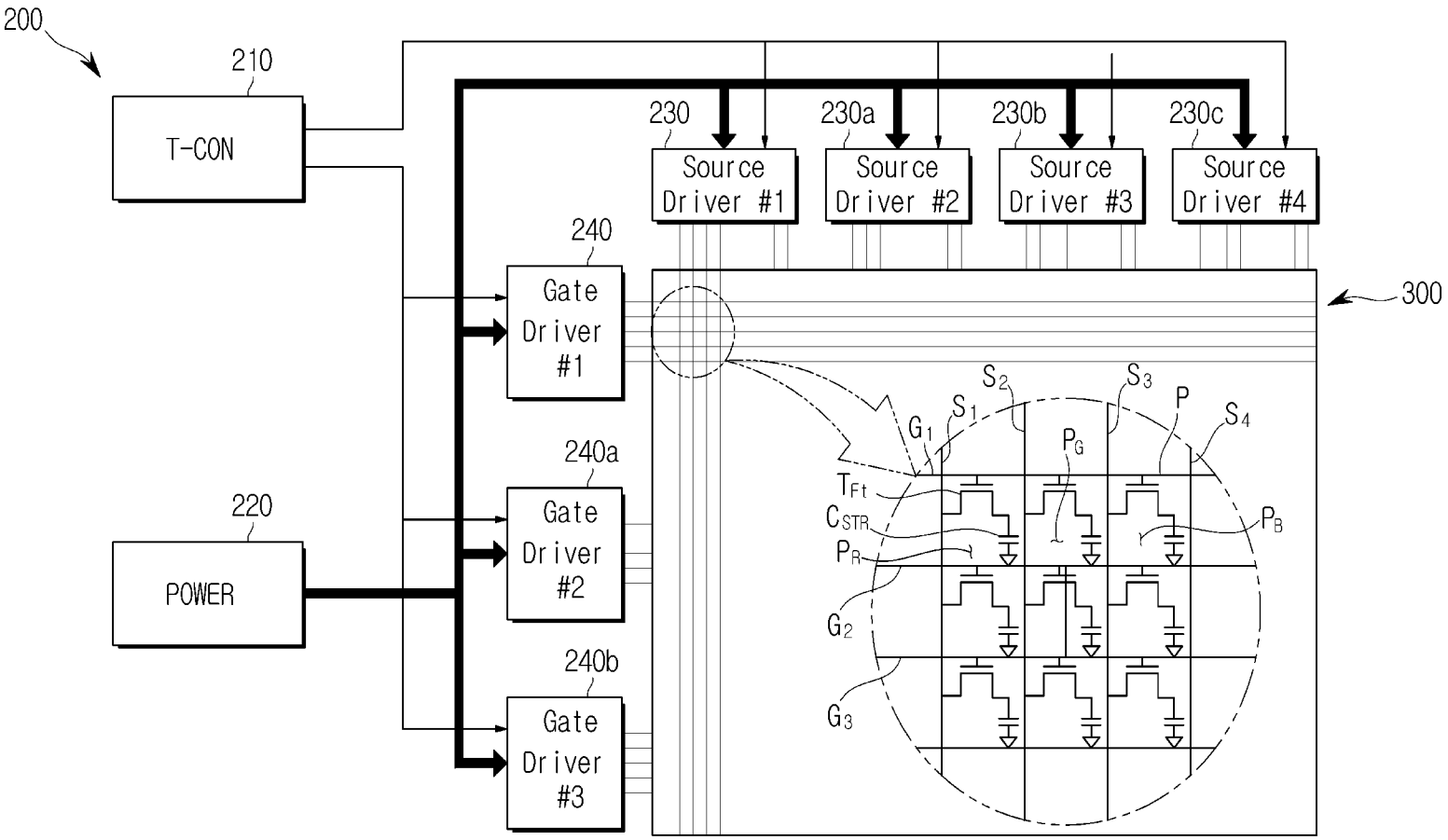
FIG. 5 is a view illustrating a display driver and a display panel included in a display apparatus according to an embodiment.

FIG. 5 is a view illustrating a display driver and a display panel included in a display apparatus according to an embodiment.

The display panel 300 may display the image by converting the electrical signal into the optical signal.

The display driver 200 may control the display panel 300 to receive the image data from the controller 130 and to display the image corresponding to the image data. For example, the display driver 200 may sequentially provide the image data to the plurality of pixels P included in the display panel 300, and each of the plurality of pixels P may emit light with various brightness and various colors according to the image data.

As illustrated in FIG. 5, the display panel 300 may include the plurality of pixels P, and each of the plurality of pixels P may be the red subpixel PR, the green subpixel PG, and the blue subpixel PB.

The plurality of subpixels PR, PG, and PB may be disposed in a two-dimension on the display panel 300. For example, the plurality of subpixels PR, PG, and PB may be arranged in a matrix on the display panel 300. In other words, the plurality of subpixels PR, PG, and PB may be disposed in rows and columns.

Further, the subpixels PR, PG, and PB may be divided into a plurality of gate lines G1, G2, and G3 and a plurality of source lines S1, S2, and S3. The plurality of gate lines G1, G2, and G3 may be connected to a gate driver 240, which will be described below, and the plurality of source lines S1, S2, and S3 may be connected to a source driver 230, which will be described below.

Each of the plurality of subpixels PR, PG, and PB may include a thin film transistor TFT and a storage capacitor CSTR.

The storage capacitor CSTR may store the image data (exactly, charge by the image data) provided to each of the plurality of subpixels PR, PG, and PB from the source driver 230, and may output the voltage corresponding to the image data. The plurality of subpixels PR, PG, and PB may emit light having brightness corresponding to the voltage output from the storage capacitor CSTR.

The thin film transistor TFT may allow or block the image data from being supplied to the storage capacitor CSTR. Since the image data is continuously provided from the source driver 230, the thin film transistor TFT may allow the appropriate image data to be selectively supplied to the storage capacitor CSTR among the image data provided continuously.

A gate terminal of the thin film transistor TFT may be connected to the gate line G1, G2, or G3, a source terminal of the thin film transistor TFT may be connected to the source line S1, S2, or S3, and a drain terminal of the thin film transistor TFT may be connected the storage capacitor CSTR.

As illustrated in FIG. 5, the display driver 200 may include a timing controller 210, a driver power supply 220, the source driver 230, and the gate driver 240.

The timing controller 210 may receive RGB image data from the controller 130 and output the image data and a driving control signal to the source driver 230 and the gate driver 240.

The image data may include color information and brightness information for each of the plurality of pixels P. Particularly, the image data may include R image data, G image data, and B image data (hereinafter, referred to as 'RGB image data') for each of the subpixels PR, PG, and PB included in the plurality of pixels P. The R image data may include brightness information of the red subpixel PR, the G image data may include brightness information of the green subpixel PG, and the B image data may include brightness information of the blue subpixel PB. For example, the RGB image data may be represented as 8 bit data, and a brightness value may have a value between '255' representing maximum brightness and '0' representing minimum brightness.

The driving control signal may include a gate driver control signal and a source driver control signal, and each control signal may control the operation of the gate driver 240 and the operation of the source driver 230.

The source driver 230 may receive the RGB image data and the source driver control signal from the timing controller 210 and output the RGB image data to the display panel 300 according to the source driver control signal. In detail, the source driver 230 may receive digital RGB image data from the timing controller 210, convert the digital RGB image data into an analog RGB image signal, and provide the analog RGB image signal to the display panel 300.

The plurality of outputs of the source driver 230 may be connected to the plurality of source lines S1, S2, and S3 of the display panel 300, respectively. The source driver 230 may output the RGB image signal to each of the plurality of subpixels PR, PG, and PB through the plurality of source lines S1, S2, and S3. In particular, the source driver 230 may simultaneously output the RGB image signal to each of the plurality of subpixels PR, PG, and PB included in the same row on the display panel 300.

The display driver 200 may include a plurality of source drivers 230, 230*a*, 230*b*, and 230*c* as illustrated in FIG. 5. Each of the plurality of source drivers 230, 230*a*, 230*b*, and 230*c* may output the RGB image signal to each of the plurality of subpixels PR, PG, and PB.

The gate driver 240 may receive the gate driver control signal from the timing controller 210 and activate one of the plurality of gate lines G1, G2, and G3 according to the gate driver control signal. For example, the gate driver 240 may output an analog activation signal among the plurality of gate lines G1, G2, and G3 according to the gate driver control signal.

As described above, the source driver 230 may output the RGB image signal through the plurality of source lines S1, S2, and S3. In this case, the RGB image signal output by the source driver 230 may be provided to all the subpixels PR, PG, and PB of the display panel 300 according to the plurality of source lines S1, S2, and S3.

The gate driver 240 may activate one of the plurality of gate lines G1, G2, and G3 such that the RGB image signal is provided to the subpixels PR, PG, and PB of an appropriate row among the subpixels PR, PG, and PB of the display panel 300. Accordingly, the thin film transistor TFT connected to the activated gate line G1, G2, or G3 may be turned on, and the RGE image signal may be transmitted to the storage capacitor CSTR through the turned on thin film transistor TFT.

In addition, the display driver 200 may include a plurality of gate drivers 240, 240*a*, and 240*b* as illustrated in FIG. 5. Each of the plurality of gate drivers 240, 240*a*, and 240*b* may activate data input of the subpixels PR, PG, and PB of the appropriate row.

The driver power supply 220 may supply DC power of various voltages to the source driver 230 and the gate driver 240.

The source driver 230 may include a digital circuit for processing the RGB image data and the source driver control signal, and an analog circuit for driving the display panel 300, respectively. In addition, the gate driver 240 may include a digital circuit for processing the gate driver control signal and an analog circuit for driving the display panel 300.

The digital circuit and the analog circuit may be supplied with DC power of different voltages. For example, the digital circuit may be supplied with low voltage (e.g., 5 V) DC power to reduce power consumption, and the analog circuit may be supplied with high voltage (e.g., 15 V) DC power to drive the display panel 300.

Accordingly, the driver power supply 220 may supply DC power having at least two different voltages to the source driver 230 and the gate driver 240.

The driver power supply 220 may receive the DC power from the power supply 160 of the display apparatus 1 and change the voltage of the supplied DC power to the source driver 230 and the gate driver 240. For example, the driver power supply 220 may include a charge pump circuit for raising the voltage of the DC power supplied from the power supply 160, and may supply the DC power boosted by the charge pump circuit and the DC power supplied from the power supply 160 to the source driver 230 and the gate driver 240.

As such, the source driver 230 and the gate driver 240 may sequentially output the RGB image signals to the plurality of subpixels PR, PG, and PB included in the display panel 300.

Information by the RGB image signal output from the source driver 230 may be stored in the storage capacitor CSTR provided in each of the plurality of subpixels PR, PG, and PB, and the storage capacitor CSTR may apply a voltage corresponding to the RGB image signal between the pixel electrode 23 (see FIG. 3) and the common electrode 26 (see FIG. 3). In other words, the voltage corresponding to the RGB image signal may be applied to the liquid crystal layer 25 (see FIG. 3), and the electric field corresponding to the RGB image signal may be formed in the liquid crystal layer 25.

The arrangement of the liquid crystal molecules 25*a* (see FIG. 3) may be changed by the electric field formed in the liquid crystal layer 25, and the optical properties of the liquid crystal layer 25 of the subpixels PR, PG, or PB may be changed. By changing the optical properties of the liquid crystal layer 25, the subpixels PR, PG, or PB may transmit or block light, and the image may be formed on the display panel 300.

At this time, when the electric field in the same direction is repeatedly formed in the liquid crystal layer 25, the change in the arrangement of the liquid crystal molecules 25*a* by the electric field may be weakened. For example, when a positive voltage (normal voltage) is repeatedly applied to both ends of the liquid crystal layer 25, the change in the arrangement of the liquid crystal molecules 25*a* by the electric field may be weakened, and an afterimage may occur on the display panel 300.

In order to prevent this, the source driver 230 may control the display panel 300 such that a negative voltage (inversion voltage) is applied to both ends of the liquid crystal layer 25 periodically (for example, every frame). For example, the source driver 230 may supply the RGB image signal to the display panel 300 such that a positive voltage (normal voltage) and the negative voltage (inversion voltage) are alternately applied to each of the subpixels PR, or PG, or PB. In other words, the source driver 230 may alternately output a normal RGB image signal and an inversion RGB image signal to each of the subpixels PR, or PG, or PB.

Hereinafter, the configuration and operation of the source driver 230 for alternately outputting the normal RGB image signal and the inversion RGB image signal will be described.

Figure 6:
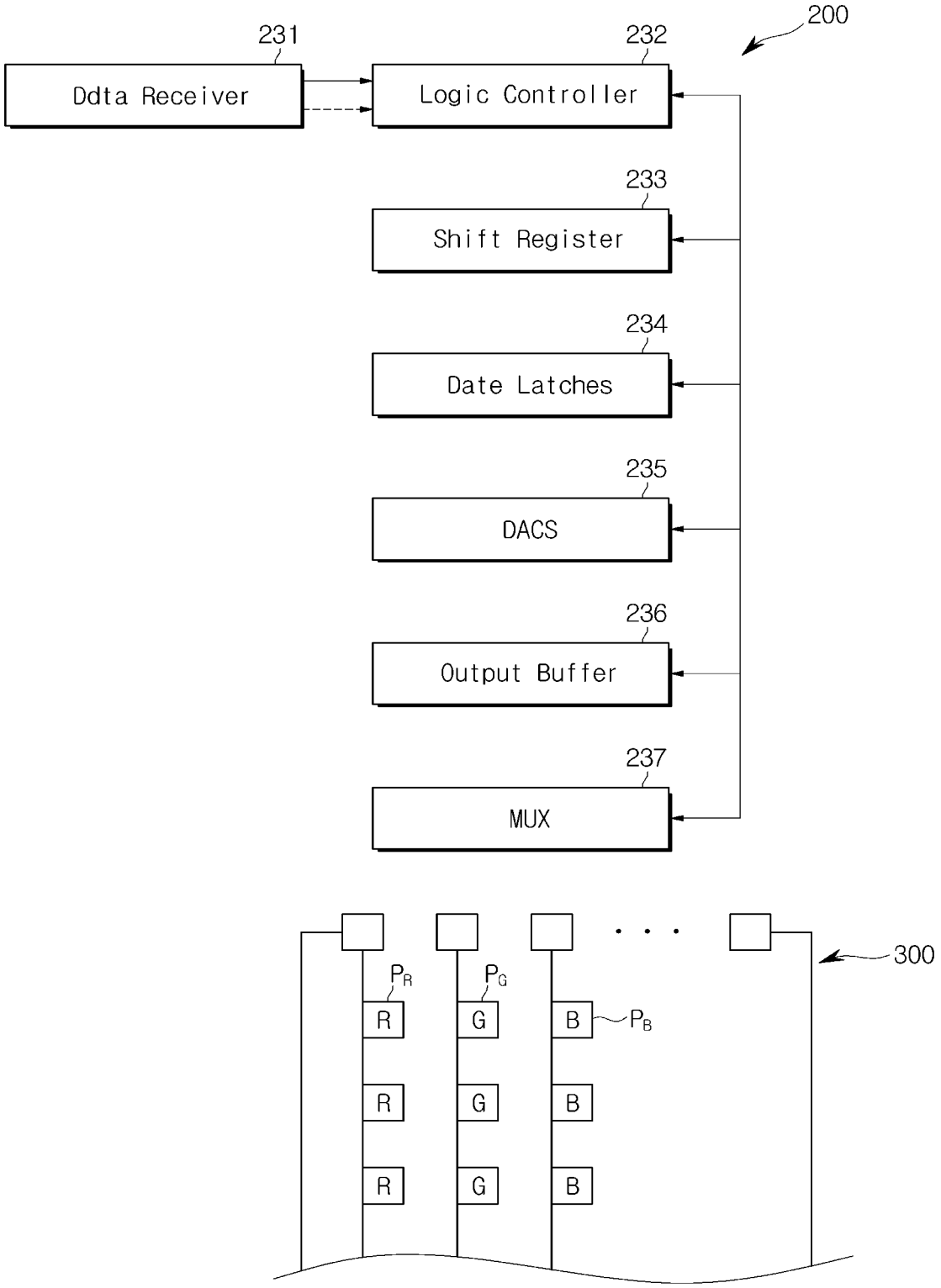
FIGS. 6 and 7 are views illustrating examples of a source driver and a display panel included in a display apparatus according to an embodiment.
Figure 7:
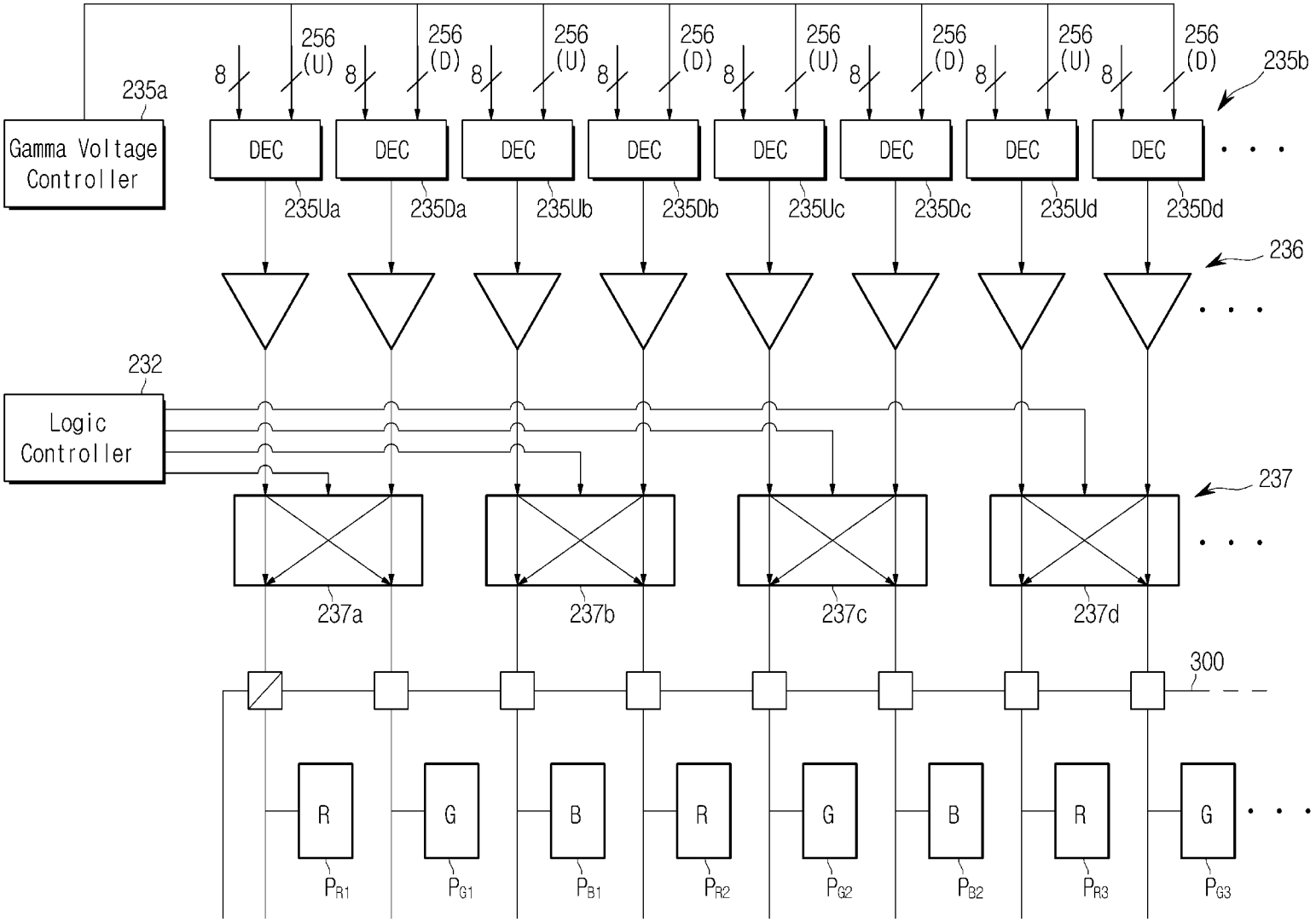
Figure 8:
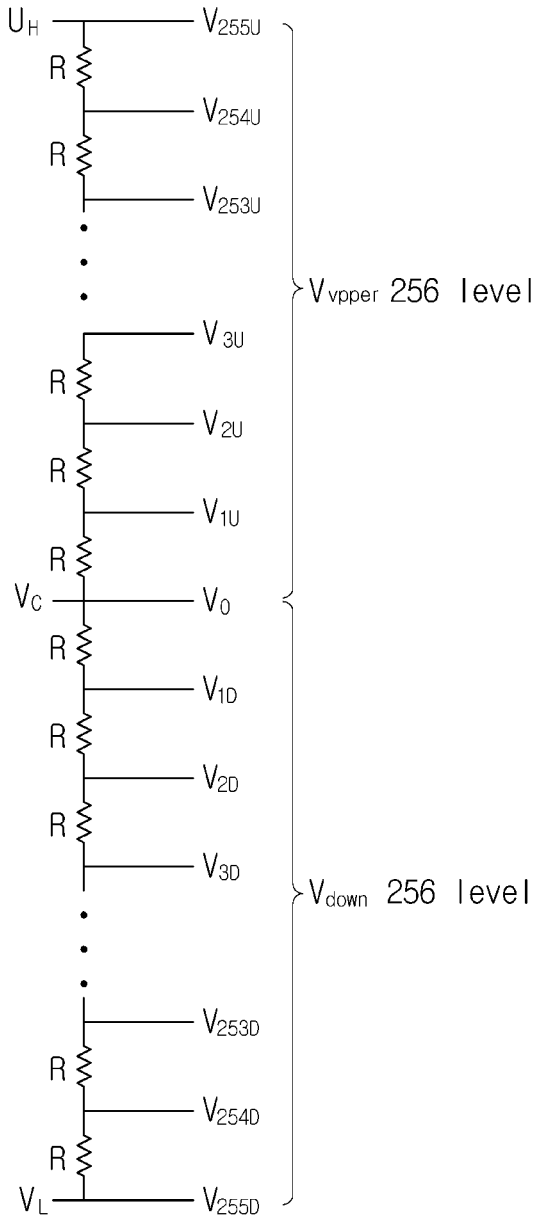
FIG. 8 is a view illustrating an example of a gamma generator included in a display apparatus according to an exemplary embodiment.

FIGS. 6 and 7 are views illustrating examples of a source driver and a display panel included in a display apparatus according to an embodiment, and FIG. 8 is a view illustrating an example of a gamma generator included in a display apparatus according to an exemplary embodiment.

Referring to FIGS. 6 and 7, the source driver 230 may include a data receiver 231, a logic controller 232, a shift register 233, a data latch 234, and a digital-analog converter 235 (hereinafter, referred to as a 'DA converter'), a plurality of output buffers 236, and a plurality of multiplexers 237.

The data receiver 231 may receive the digital RGB image data and the source driver control signal from the timing controller 210. For example, the digital RGB data may be transmitted in the form of low voltage differential signaling (LVDS) from the timing controller 210, and the data receiver 231 may receive the LVDS signal from the timing controller 210 and recover the digital RGB image data from the LVDS signal.

The data receiver 231 may output the digital RGB image data and the source driver control signal to the logic controller 232.

The logic controller 232 may output the digital RGB image data to the shift register 233, and may control operations of the shift register 233, the data latch 234, the DA converter, the plurality of output buffers 236, and the plurality of multiplexers 237 according to the source driver control signal. For example, the logic controller 232 may output control signals to the shift register 233, the data latch 234, the DA converter, the plurality of output buffers 236, and the plurality of multiplexers 237 to convert the digital RGB image data into a normal analog RGB image signal and an inversion analog RGB image signal.

The logic controller 232 may sequentially output the digital RGB image data to the shift register 233.

The shift register 233 may include a plurality of flip-flops connected in series, and may convert a serial input signal into a parallel output signal. In detail, the shift register 233 may sequentially receive the digital RGB image data from the logic controller 232 (serial input) and simultaneously output the sequentially received digital RGB image data through a plurality of output terminals (parallel output).

The serial digital RGB image data may be converted into parallel digital RGB image data by the shift register 233.

The data latch 234 may include a plurality of flip-flops connected in parallel, and may temporarily store a plurality of bits of data. In detail, the data latch 234 may temporarily store the parallel digital RGB image data output from the shift register 233.

The DA converter 235 may convert the digital data into the analog signal. In detail, the DA converter 235 may convert the digital RGB image data output from the data latch 234 into the analog RGB image signal, and may output the analog RGB image signal to the plurality of output buffers 236.

Referring to FIG. 7, the DA converter 235 may include a gamma voltage generator 235*a* for generating a reference voltage of the analog RGB image signal, and a plurality of decoders 235*b* for decoding the digital RGB image data.

The gamma voltage generator 235*a* may output a plurality of gamma reference voltages. For example, the gamma voltage generator 235*a* may output 256 upper reference voltages V0, V1U, V2U, . . . , V254U, and V255U between a center voltage VC and a highest voltage VH to the plurality of decoders 235*b*, and may output 256 lower reference voltages V0, V1D, V2D, . . . , V254D, and V255D between the center voltage VC and a lowest voltage VL to the plurality of decoders 235*b*. In addition, the center voltage VC may be output to the common electrode 26 (see FIG. 3).

The gamma voltage generator 235*a* may be implemented as a voltage divider capable of outputting a plurality of gamma reference voltages. For example, as illustrated in FIG. 8, the gamma voltage generator 235*a* may include a plurality of resistors R connected in series with each other. 255 of the resistors R may be connected in series between the center voltage VC and the highest voltage VH, and the upper reference voltages V0, V1U, V2U, . . . , V254U, and V255U may be output between the resistors R. In addition, 255 of the resistors R may be connected in series between the center voltage VC and the lowest voltage VL, and the lower reference voltages V0, V1D, V2D, . . . , V254D, and V255D may be output between the resistors R.

In order that the display apparatus 1 has a non-linear gamma value, the plurality of resistors R constituting the gamma voltage generator 235*a* may have different electric resistance values. In addition, the gamma voltage generator 235*a* may include a plurality of variable resistors whose resistance values change so that the gamma value of the display apparatus 1 may be changed.

Each of the plurality of decoders 235*b* may decode the digital RGB image data output from the data latch 234, and may select and output one of the plurality of gamma reference voltages output from the gamma voltage generator 235*a* according to the decoded digital RGB image data.

For example, the digital RGB image data may be 8 bits of data, and each of the decoders 235*b* may convert 8 bits of data into 256 bits of data. In other words, each of the plurality of decoders 235*b* may be an 8-to-256 decoder. In addition, each of the plurality of decoders 235*b* may select one of the plurality of gamma reference voltages based on the decoded 256 bits of data and output the selected gamma reference voltage.

The plurality of decoders 235*b* may include normal decoders 235Ua to 235Ud in which the upper reference voltages V0, V1U, V2U, . . . , V254U, and V255U are input between the center voltage VC and the highest voltage VH and inverted decoders 235Da to 235Dd in which the lower reference voltages V0, V1D, V2D, . . . , V254D, and V255D are input between the center voltage VC and the lowest voltage VL.

The normal decoders 235Ua to 235Ud may convert the digital RGB image data into the normal analog RGB image signal having the voltage between the center voltage VC and the highest voltage VH. For example, the normal decoders 235Ua to 235Ud may receive 8-bit digital RGB image data, and may output the normal analog RGB image signal having any one of the upper reference voltages V0, V1U, V2U, . . . , V254U, and V255U.

The inverted decoders 235Da to 235Dd may convert the digital RGB image data into the inversion analog RGB image signal having the voltage between the center voltage VC and the lowest voltage VL. For example, the inverted decoders 235Da to 235Dd may receive 8-bit digital RGB image data, and may output the inversion analog RGB image signal having any one of the lower reference voltages V0, V1D, V2D, . . . , V254D, and V255D according to the 8-bit digital RGB image data, The normal decoders 235Ua to 235Ud and the inverted decoders 235Da to 235Dd may be disposed adjacent to each other. In other words, the normal decoders 235Ua to 235Ud and the inverted decoders 235Da to 235Dd may be alternately arranged.

The plurality of decoders 235*b* may include the first normal decoder 235Ua, the first inverted decoder 235Da, the second normal decoder 235Ub, the second inverted decoder 235Db, and the third normal decoder 235Uc, the third inverted decoder 235Dc, the fourth normal decoder 235Ud, the fourth inverted decoder 235Dd, and the like. The source driver 230 may include a larger number of the decoders than the decoders 235*b* illustrated in FIG. 7.

The DA converter 235 may output the analog RGB image signal converted from the digital RGB image data to the plurality of output buffers 236. In detail, the normal decoders 235Ua to 235Ud and the inverted decoders 235Da to 235Dd may output the normal analog RGB image signal and the inversion analog RGB image signal to the plurality of output buffers 236, respectively.

The plurality of output buffers 236 may remove noise of the analog RGB image signal output from the DA converter 235 and amplify a current of the analog RGB image signal to supply sufficient current to the display panel 300.

As such, the plurality of output buffers 236 may be a current amplifier for amplifying the current of the analog RGB image signal, and the analog RGB image signal output from the plurality of output buffers 236 may be transmitted to the end of the display panel 300.

Each of the plurality of multiplexers 237 may receive a pair of the analog RGB image signals from the plurality of output buffers 236, and may directly output or cross output the pair of analog RGB image signals. For example, as illustrated in FIG. 7, each of the multiplexers 237 may receive the normal analog RGB image signal and the inversion analog RGB image signal from the plurality of output buffers 236. In addition, each of the multiplexers 237 may receive an inversion control signal from the logic controller 232.

In particular, when the pair of analog RGB image signals (normal analog RGB image signal and inversion analog RGB image signal) are cross output in the multiplexers 237, the digital RGB image signals may be crossed in a previous step (e.g., shift register or data latch) of the multiplexers 237 to prevent distortion of the image displayed on the liquid crystal panel 20. In addition, when the pair of analog RGB image signals are output from the multiplexers 237 as they are, the digital RGB image signals may be output as they are even in the previous step of the multiplexers 237.

For example, in a first frame, the shift register 233 or the data latch 234 may cross output the pair of digital RGB image data corresponding to the normal analog RGB image signal and the inversion analog RGB image signal, and the multiplexers 237 may cross output the normal analog RGB image signal and the inversion analog RGB image signal. In addition, in a second frame, the shift register 233 and the data latch 234 may output the pair of digital RGB image data corresponding to the normal analog RGB image signal and the inversion analog RGB image signal as they are, and the multiplexers 237 may output the normal analog RGB image signal and the inversion analog RGB image signal as they are.

As described above, the shift register 233 or the data latch 234 may cross output the digital RGB image data, or may output the digital RGB image data depending on whether the multiplexers 237 cross output the normal analog RGB image signal and the inversion analog RGB image signal, or output the normal analog RGB image signal and the inversion analog RGB image signal as they are.

The plurality of multiplexers 237 may include a first multiplexer 237*a*, a second multiplexer 237*b*, a third multiplexer 237*c*, a fourth multiplexer 237*d*, and the like. The source driver 230 may include a larger number of the multiplexers in addition to the multiplexers 237 illustrated in FIG. 7.

The first multiplexer 237*a* may receive the RGB image signal output from the first normal decoder 235Ua and the first inverted decoder 235Da, and the second multiplexer 237*b* may receive the RGB image signal output from the second normal decoder 235Ub and the second inverted decoder 235Db. In addition, the third multiplexer 237*c* may receive the RGB image signal output from the third normal decoder 235Uc and the third inverted decoder 235Dc, and the fourth multiplexer 237*d* may receive the RGB image signal output from the fourth normal decoder 235Ud and the fourth inverted decoder 235Dd.

Each of the plurality of multiplexers 237 may output the normal analog RGB image signal and the inversion analog RGB image signal as they are, or may cross output the normal analog RGB image signal and the inversion analog RGB image signal, according to the inversion control signal of the logic controller 232. For example, when a first control signal is received from the logic controller 232, the plurality of multiplexers 237 may output the normal analog RGB image signal and the inversion analog RGB image signal as they are. When a second control signal is received from the logic controller 232, the plurality of multiplexers 237 may cross output the normal analog RGB image signal and the inversion analog RGB image signal.

In particular, the plurality of multiplexers 237 may receive the control signal independently from the logic controller 232, and may directly output or cross output the normal analog RGB image signal and the inversion analog RGB image signal according to the control signal of the logic controller 232.

The analog RGB image signals respectively output from the multiplexers 237 may be supplied to the subpixels PR, PG, and PB. In detail, the analog RGB image signal may be supplied to the subpixels PR, PG, and PB of the row activated by the gate driver 240. For example, the RGB image signal output from the first multiplexer 237*a* may be input to a first red subpixel PR1 and a first green subpixel PG1, and the RGB image signal output from the second multiplexer 237*b* may be output to a first blue subpixel PB1 and a second red subpixel PR2. In addition, the RGB image signal output from the third multiplexer 237*c* may be input to a second green subpixel PG2 and a second blue subpixel PB2, and the RGB image signal output from the fourth multiplexer 237*d* may be input to a third red subpixel PR3 and a third green subpixel PG3.

As such, the operation (direct output or cross output) of the multiplexers 237 may be controlled by the inversion control signal (first control signal or second control signal) output from the logic controller 232. In addition, the logic controller 232 may receive the inversion control signal from the timing controller 210, and the timing controller 210 may receive the inversion control signal from the controller 130.

In response to the inversion control signal output from the logic controller 232 according to the inversion mode of the source driver 230, the plurality of multiplexers 237 may directly output or cross output the RGB image signal.

Hereinafter, the inversion modes of the source driver 230 will be described.

Figure 9:
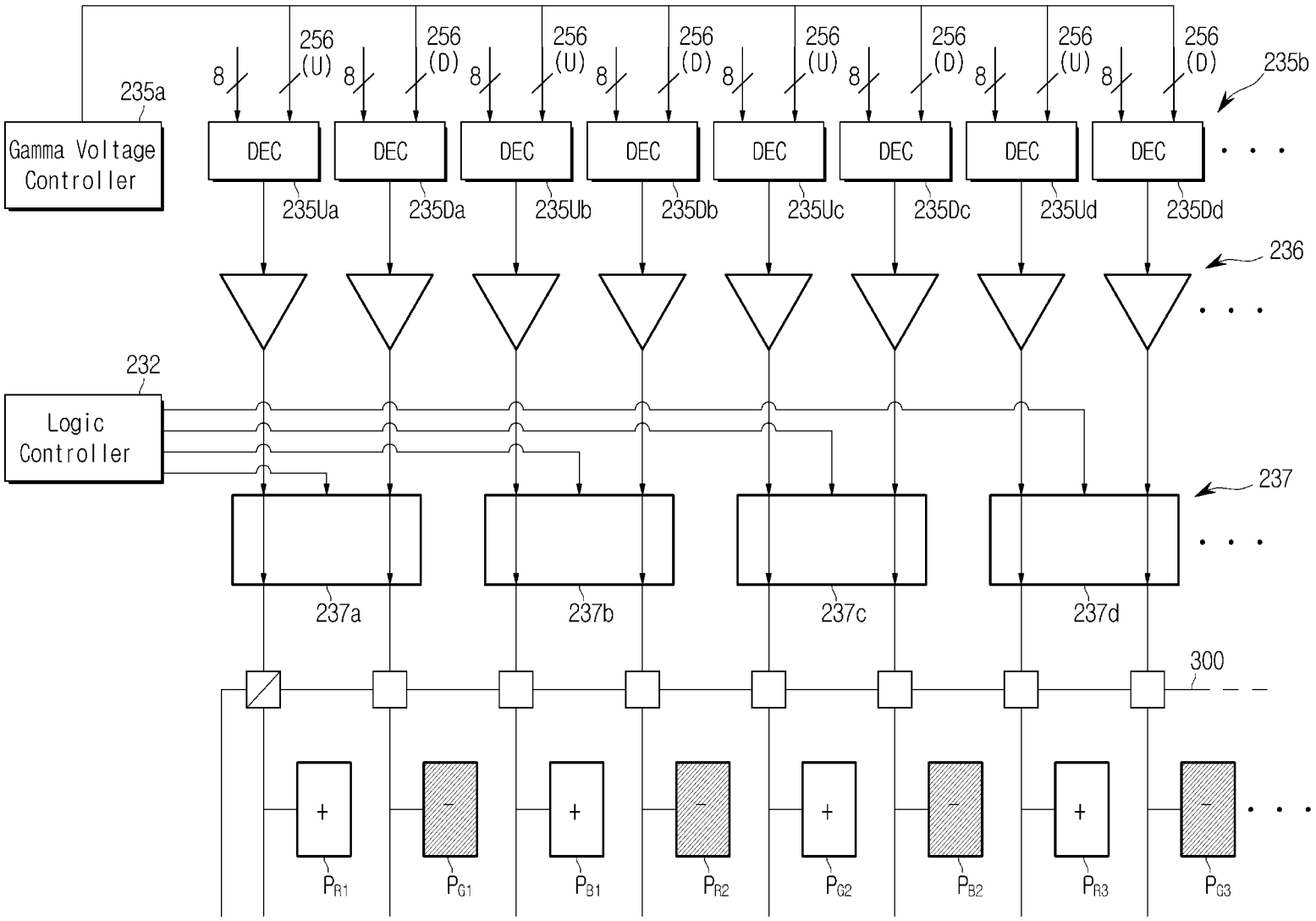
FIGS. 9 and 10 are views illustrating an example of an inversion operation of a display apparatus according to an embodiment.
Figure 10:
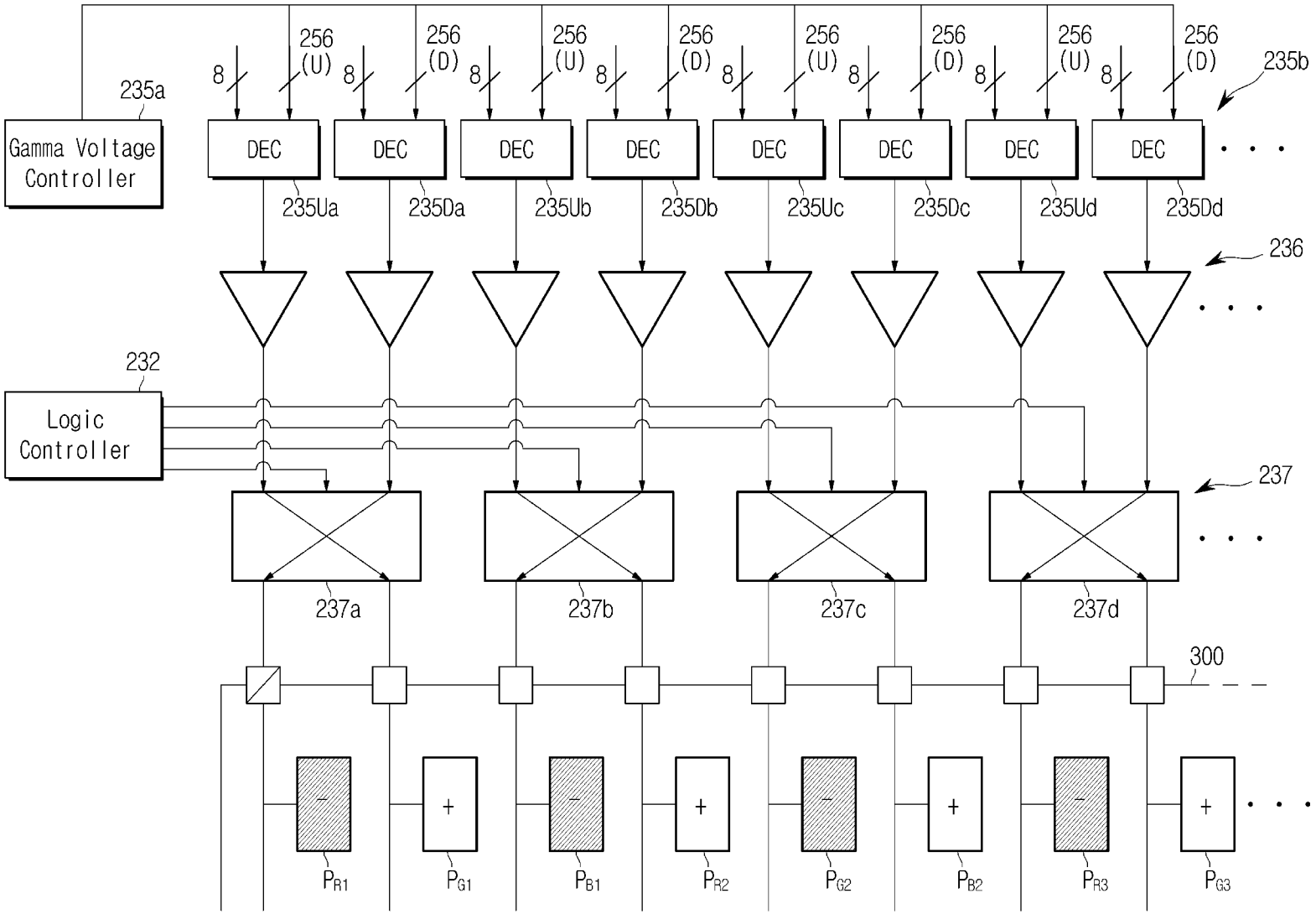

FIGS. 9 and 10 are views illustrating an example of an inversion operation of a display apparatus according to an embodiment.

In a first inversion mode, the same control signal may be input to all the multiplexers 237.

For example, in the first frame, the plurality of multiplexers 237 may receive the first control signal from the logic controller 232 and directly output the RGB image signal as illustrated in FIG. 9.

In response to the first control signal of the logic controller 232, the first multiplexer 237*a* may output the normal RGB image signal output from the first normal decoder 235Ua to the first red subpixel PR1 and output the inversion RGB image signal output from the first inverted decoder 235Da to the first green subpixel PG1.

In response to the first control signal of the logic controller 232, the second multiplexer 237*b* may output the normal RGB image signal output from the second normal decoder 235Ub to the first blue subpixel PB1 and output the inversion RGB image signal output from the second inverted decoder 235Db to the second red subpixel PR2.

In response to the first control signal of the logic controller 232, the third multiplexer 237*c* may output the normal RGB image signal output from the third normal decoder 235Uc to the second green subpixel PG2 and output the inversion RGB image signal output from the third inverted decoder 235Dc to the second blue subpixel PB2.

In response to the first control signal of the logic controller 232, the fourth multiplexer 237*d* may output the normal RGB image signal output from the fourth normal decoder 235Ud to the third red subpixel PR3 and output the inversion RGB image signal output from the fourth inverted decoder 235Dd to the third green subpixel PG3.

In addition, in the second frame, the plurality of multiplexers 237 may receive the second control signal from the logic controller 232 and cross output all of the RGB image signals as illustrated in FIG. 10.

In response to the second control signal of the logic controller 232, the first multiplexer 237*a* may output the normal RGB image signal output from the first normal decoder 235Ua to the first green subpixel PG1 and output the inversion RGB image signal output from the first inverted decoder 235Da to the first red subpixel PR1.

In response to the second control signal of the logic controller 232, the second multiplexer 237*b* may output the normal RGB image signal output from the second normal decoder 235Ub to the first red subpixel PR1 and output the inversion RGB image signal output from the second inverted decoder 235Db to the first blue subpixel PB1.

In response to the second control signal of the logic controller 232, the third multiplexer 237*c* may output the normal RGB image signal output from the third normal decoder 235Uc to the second blue subpixel PB2 and output the inversion RGB image signal output from the third inverted decoder 235Dc to the second green subpixel PG2.

In response to the second control signal of the logic controller 232, the fourth multiplexer 237*d* may output the normal RGB image signal output from the fourth normal decoder 235Ud to the third green subpixel PG3 and output the inversion RGB image signal output from the fourth inverted decoder 235Dd to the third red subpixel PR3.

In a third frame, the plurality of multiplexers 237 may receive the first control signal from the logic controller 232. In a fourth frame, the plurality of multiplexers 237 may receive may receive the second control signal from the logic controller 232.

As such, the multiplexers 237 may receive the same inversion control signal all in one frame.

Figure 11:
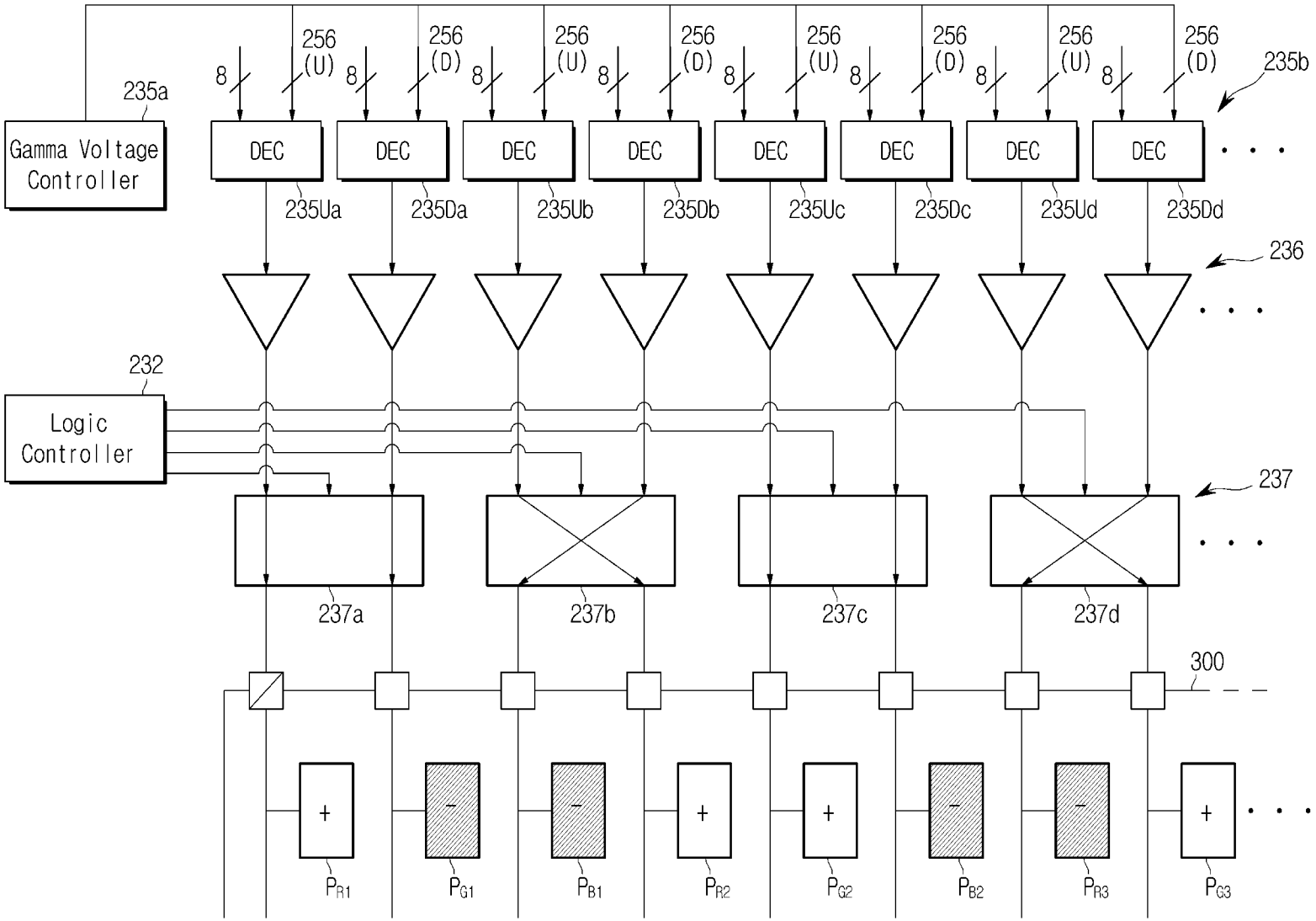
FIGS. 11 and 12 are views illustrating another example of an inversion operation of a display apparatus according to an embodiment.
Figure 12:
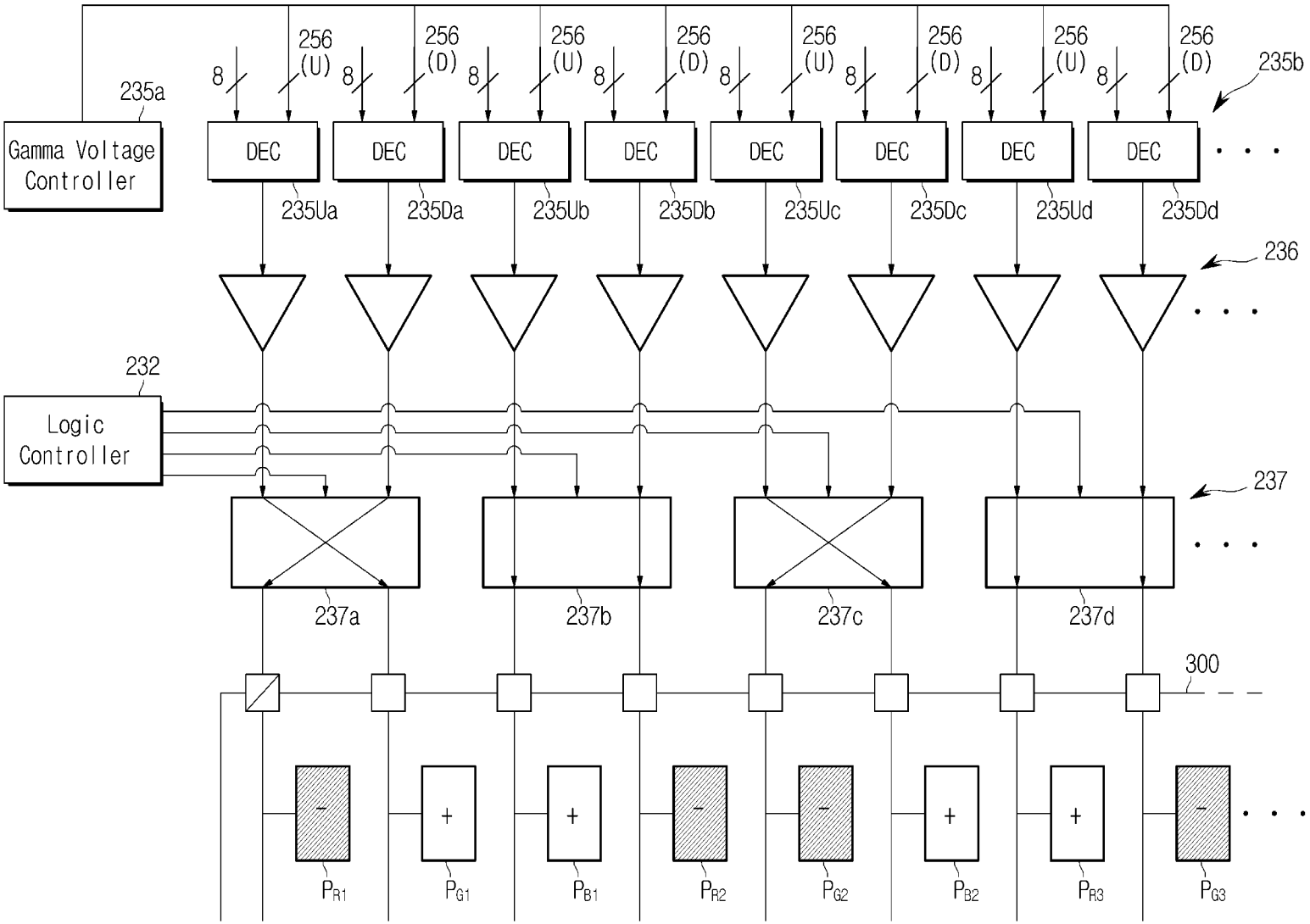

FIGS. 11 and 12 are views illustrating another example of an inversion operation of a display apparatus according to an embodiment.

In a second inversion mode, the first control signal and the second control signal may be alternately input according to positions of the multiplexers 237.

For example, in the first frame, the first multiplexer 237*a* and the third multiplexer 237*c* may receive the first control signal from the logic controller 232 and directly output the RGB image signal as illustrated in FIG. 11. In addition, in the second frame, the second multiplexer 237*b* and the fourth multiplexer 237*d* may receive the second control signal from the logic controller 232 and cross output the RGB image signal as illustrated in FIG. 11.

In response to the second control signal of the logic controller 232, the first multiplexer 237*a* may output the normal RGB image signal output from the first normal decoder 235Ua to the first green subpixel PG1 and output the inversion RGB image signal output from the first inverted decoder 235Da to the first red subpixel PR1.

In response to the second control signal of the logic controller 232, the second multiplexer 237*b* may output the normal RGB image signal output from the second normal decoder 235Ub to the second red subpixel PR2 and output the inversion RGB image signal output from the second inverted decoder 235Db to the first blue subpixel PB1.

In response to the first control signal of the logic controller 232, the third multiplexer 237*c* may output the normal RGB image signal output from the third normal decoder 235Uc to the second green subpixel PG2 and output the inversion RGB image signal output from the third inverted decoder 235Dc to the second blue subpixel PB2.

In response to the second control signal of the logic controller 232, the fourth multiplexer 237*d* may output the normal RGB image signal output from the fourth normal decoder 235Ud to the third green subpixel PG3 and output the inversion RGB image signal output from the fourth inverted decoder 235Dd to the third red subpixel PR3.

In addition, in the second frame, the first multiplexer 237*a* and the third multiplexer 237*c* may receive the second control signal from the logic controller 232 and cross output the RGB image signal as illustrated in FIG. 12. In addition, in the second frame, the second multiplexer 237*b* and the fourth multiplexer 237*d* may receive the first control signal from the logic controller 232 and directly output the RGB image signal as illustrated in FIG. 12.

In response to the second control signal of the logic controller 232, the first multiplexer 237*a* may output the normal RGB image signal output from the first normal decoder 235Ua to the first green subpixel PG1 and output the inversion RGB image signal output from the first inverted decoder 235Da to the first red subpixel PR1.

In response to the first control signal of the logic controller 232, the second multiplexer 237*b* may output the normal RGB image signal output from the second normal decoder 235Ub to the first blue subpixel PB1 and output the inversion RGB image signal output from the second inverted decoder 235Db to the second red subpixel PR2.

In response to the second control signal of the logic controller 232, the third multiplexer 237*c* may output the normal RGB image signal output from the third normal decoder 235Uc to the second blue subpixel PB2 and output the inversion RGB image signal output from the third inverted decoder 235Dc to the second green subpixel PG2.

In response to the first control signal of the logic controller 232, the fourth multiplexer 237*d* may output the normal RGB image signal output from the fourth normal decoder 235Ud to the third red subpixel PR3 and output the inversion RGB image signal output from the fourth inverted decoder 235Dd to the third green subpixel PG3.

In the third frame, the first multiplexer 237*a* and the third multiplexer 237*c* may receive the first control signal from the logic controller 232, and the second multiplexer 237*b* and the fourth multiplexer 237*d* may output the second signal. In the fourth frame, the first multiplexer 237*a* and the third multiplexer 237*c* may receive the second control signal from the logic controller 232, and the second multiplexer 237*b* and the fourth multiplexer 237*d* may output the first control signal.

As such, in the same frame, the first control signal and the second control signal may be alternately input according to the positions of the plurality of multiplexers 237.

Figure 13:
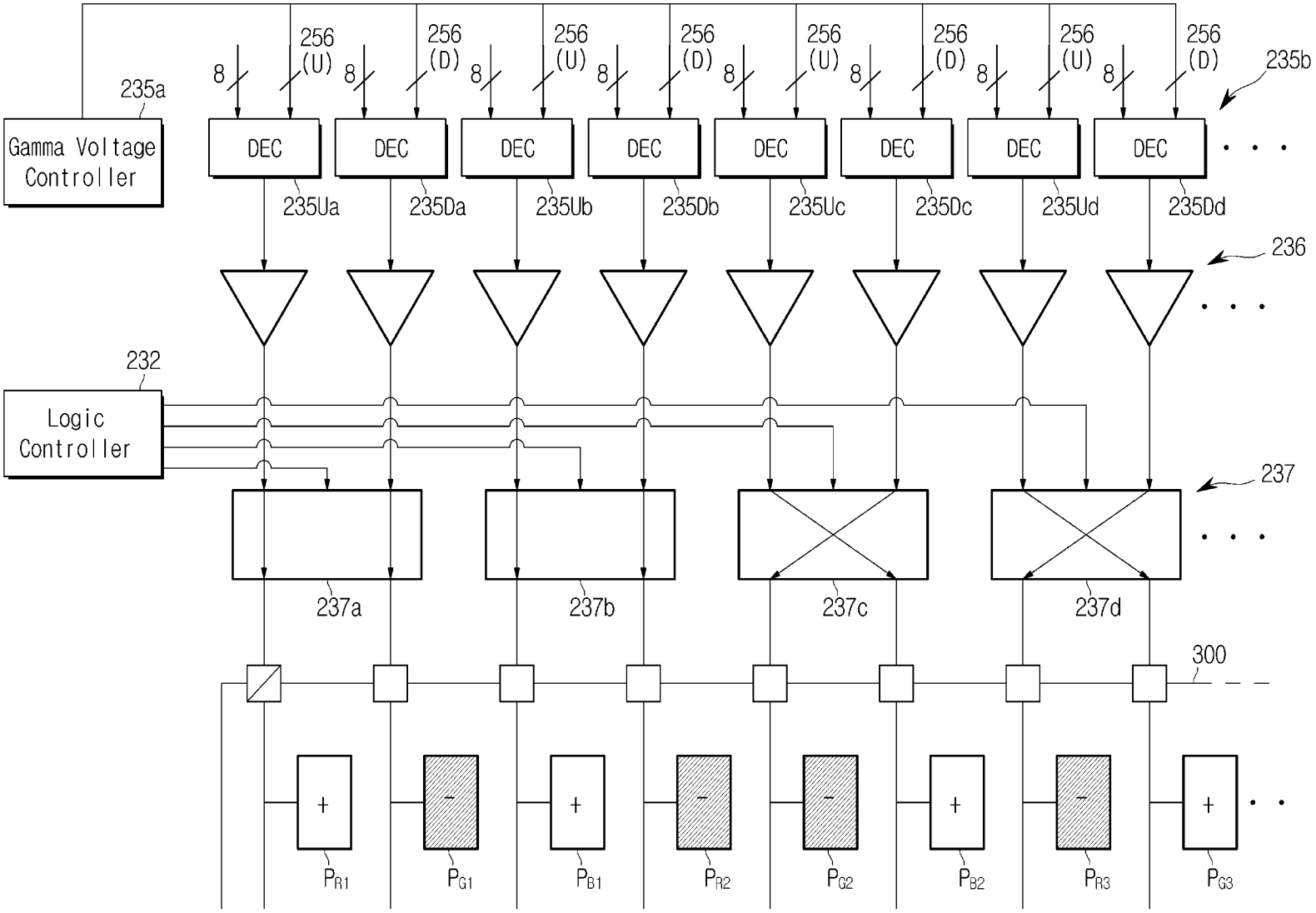
FIG. 13 is a view illustrating another example of an inversion operation of a display apparatus according to an embodiment.

FIG. 13 is a view illustrating another example of an inversion operation of a display apparatus according to an embodiment.

In a third inversion mode, the first control signal and the second control signal may be alternately input according to positions of the multiplexers 237.

For example, in the first frame, the first multiplexer 237*a* and the second multiplexer 237*b* may receive the first control signal from the logic controller 232 and directly output the RGB image signal as illustrated in FIG. 13. In addition, in the second frame, the third multiplexer 237*c* and the fourth multiplexer 237*d* may receive the second control signal from the logic controller 232 and cross output the RGB image signal as illustrated in FIG. 13.

In addition, in the second frame, the first multiplexer 237*a* and the second multiplexer 237*b* may receive the second control signal from the logic controller 232 and cross output the RGB image signal. In the second frame, the third multiplexer 237*c* and the fourth multiplexer 237*d* may receive the first control signal from the logic controller 232 and directly output the RGB image signal.

Figure 14:
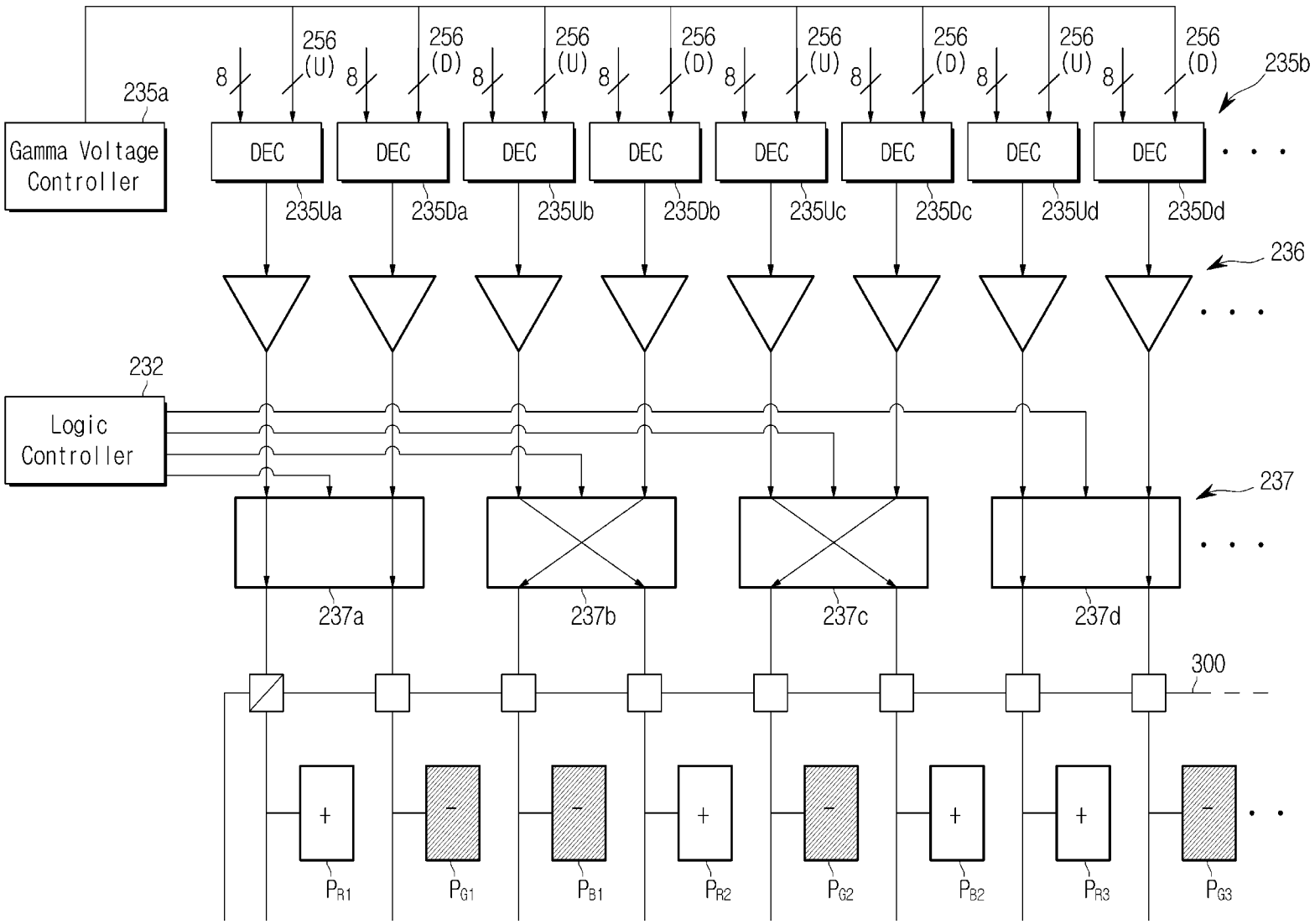
FIG. 14 is a view illustrating another example of an inversion operation of a display apparatus according to an embodiment.

FIG. 14 is a view illustrating another example of an inversion operation of a display apparatus according to an embodiment.

In a fourth inversion mode, the first control signal and the second control signal may be alternately input according to positions of the multiplexers 237.

For example, in the first frame, the first multiplexer 237*a* and the fourth multiplexer 237*d* may receive the first control signal from the logic controller 232 and directly output the RGB image signal as illustrated in FIG. 14. In addition, in the second frame, the second multiplexer 237*b* and the third multiplexer 237*c* may receive the second control signal from the logic controller 232 and cross output the RGB image signal as illustrated in FIG. 14.

In addition, in the second frame, the first multiplexer 237*a* and the fourth multiplexer 237*d* may receive the second control signal from the logic controller 232 and cross output the RGB image signal. In the second frame, the second multiplexer 237*b* and the third multiplexer 237*c* may receive the first control signal from the logic controller 232 and directly output the RGB image signal.

Figure 15:
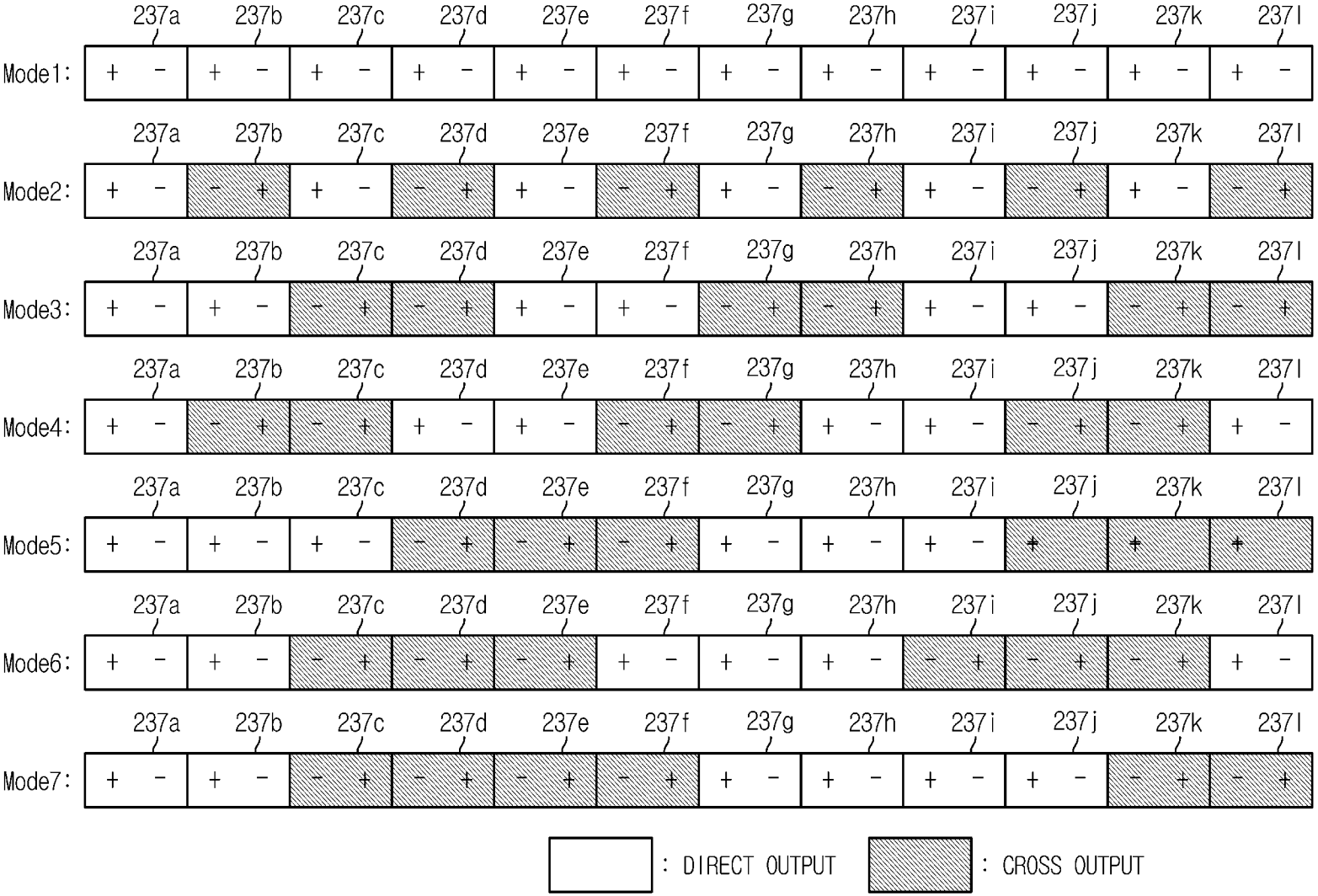
FIG. 15 is a view illustrating operable inversion modes of a display apparatus according to an embodiment.

FIG. 15 is a view illustrating operable inversion modes of a display apparatus according to an embodiment.

Referring to FIG. 15, in various inversion modes of the source driver 230, the plurality of multiplexers 237 may directly output or cross output the RGB image signal.

In the first inversion mode (Mode 1), all of the multiplexers 237*a* to 237*l* may directly output the RGB image signal. In addition, in a next frame, the multiplexers 237*a* through 237*l* may cross output the RGB image signal.

In the second inversion mode (Mode 2), the multiplexers 237 may directly output or cross output the RGB image signal according to the position. The first, third, fifth, seventh, ninth, and eleventh multiplexers 237*a*, 237*c*, 237*e*, 237*g*, 237*i*, and 237*k* may directly output the RGB image signal, and the second, fourth, sixth, eighth, tenth, and twelfth multiplexers 237*b*, 237*d*, 237*f*, 237*h*, 237*j*, and 237*l* may cross output the RGB image signal. Also, in the next frame, the first, third, fifth, seventh, ninth, and eleventh multiplexers 237*a*, 237*c*, 237*e*, 237*g*, 237*i*, and 237*k* may cross output the RGB image signal, and the fourth, sixth, eighth, tenth, and twelfth multiplexers 237*d*, 237*f*, 237*h*, 237*j*, and 237*l* may directly output the RGB image signal.

In the third inversion mode (Mode 3), the plurality of multiplexers 237 may directly output or cross output the RGB image signal according to the position. The first, second, fifth, sixth, ninth, and tenth multiplexers 237*a*, 237*b*, 237*e*, 237*f*, 237*i*, and 237*j* may directly output the RGB image signal, and the third, fourth, seventh, eighth, eleventh, and twelfth multiplexers 237*c*, 237*d*, 237*g*, 237*h*, 237*k*, and 237*l* may cross output the RGB image signal. Also, in the next frame, the first, second, fifth, sixth, ninth and tenth multiplexers 237*a*, 237*b*, 237*e*, 237*f*, 237*i*, and 237*j* may cross output the RGB image signal, and the third, fourth, seventh, eighth, eleventh, and twelfth multiplexers 237*c*, 237*d*, 237*g*, 237*h*, 237*k*, and 237*l* may directly output the RGB image signal.

In the fourth inversion mode (Mode 4), the plurality of multiplexers 237 may directly output or cross output the RGB image signal according to the position. The first, fourth, fifth, eighth, ninth, and twelfth multiplexers 237*a*, 237*d*, 237*e*, 237*h*, 237*i*, and 237*l* may directly output the RGB image signal, and the second, third, sixth, seventh, tenth, and eleventh multiplexers 237*b*, 237*c*, 237*f*, 237*g*, 237*j*, and 237*k* may cross output the RGB image signal. In addition, in the next frame, the first, fourth, fifth, eighth, ninth, and twelfth multiplexers 237*a*, 237*d*, 237*e*, 237*h*, 237*i*, and 237*l* may cross output the RGB image signal, and the third, sixth, seventh, tenth, and eleventh multiplexers 237*c*, 237*f*, 237*g*, 237*j*, and 237*k* may directly output the RGB image signal.

In a fifth inversion mode (Mode 5), the plurality of multiplexers 237 may directly output or cross output the RGB image signal according to the position. The first, second, third, seventh, eighth and ninth multiplexers 237*a*, 237*b*, 237*c*, 237*g*, 237*h*, and 237*i* may directly output the RGB image signal, and the fourth, fifth, sixth, tenth, eleventh, and twelfth multiplexers 237*d*, 237*e*, 237*f*, 237*j*, 237*k*, and 237*l* may cross output the RGB image signal. Also, in the next frame, the first, second, third, seventh, eighth and ninth multiplexers 237*a*, 237*b*, 237*c*, 237*g*, 237*h*, and 237*i* may cross output the RGB image signal, and the fifth, sixth, tenth, eleventh, and twelfth multiplexers 237*e*, 237*f*, 237*j*, 237*k*, and 237*l* may directly output the RGB image signal.

In a sixth inversion mode (Mode 6), the plurality of multiplexers 237 may directly output or cross output the RGB image signal according to the position. The first, second, sixth, seventh, eighth, and twelfth multiplexers 237*a*, 237*b*, 237*f*, 237*g*, 237*h*, and 237*l* may directly output the RGB image signal, and the third, fourth, fifth, ninth, tenth, and eleventh multiplexers 237*c*, 237*d*, 237*e*, 237*i*, 237*j*, and 237*k* may cross output the RGB image signal. Further, in the next frame, the first, second, sixth, seventh, eighth, and twelfth multiplexers 237*a*, 237*b*, 237*f*, 237*g*, 237*h*, and 237*l* may cross output the RGB image signal, and the third, fourth, fifth, ninth, tenth, and eleventh multiplexers 237*c*, 237*d*, 237*e*, 237*i*, 237*j*, and 237*k* may directly output the RGB image signal.

In a seventh inversion mode (Mode 7), the multiplexers 237 may directly output or cross output the RGB image signal according to the position. The first, second, seventh, eighth, ninth, and tenth multiplexers 237*a*, 237*b*, 237*g*, 237*h*, 237*i*, and 237*j* may directly output the RGB image signal, and the third, fourth, fifth, sixth, eleventh, and twelfth multiplexers 237*c*, 237*d*, 237*e*, 237*f*, 237*k*, and 237*l* may cross output the RGB image signal. Further, in the next frame, the first, second, seventh, eighth, ninth, and tenth multiplexers 237*a*, 237*b*, 237*g*, 237*h*, 237*i*, and 237*j* may cross output the RGB image signal, and the third, fourth, fifth, sixth, eleventh, and twelfth multiplexers 237*c*, 237*d*, 237*e*, 237*f*, 237*k*, and 237*l* may directly output the RGB image signal.

The controller 130 of the display apparatus 1 may select one of the first to seventh inversion modes according to the contents and the information about the selection of the inversion mode may transmit to the timing controller 210 of the display driver 200. The timing controller 210 may output the information about the selection of the inversion mode received from the controller 130 to the logic controller 232. The logic controller 232 may output any one of the first control signal and the second control signal to the multiplexers 237 according to the selected inversion mode.

The inversion modes illustrated in FIG. 15 are merely examples of the inversion mode of the source driver 230, and the inversion mode of the source driver 230 is not limited to that illustrated in FIG. 15.

In addition, the inversion mode of the source driver 230 may change over time. For example, in the first frame and the second frame, the source driver 230 may operate in the first inversion mode, and in the third frame and the fourth frame, the source driver 230 may operate in the second inversion mode. In addition, in the fifth frame and the sixth frame, the source driver 230 may operate in the first inversion mode again. As such, the inversion mode of the source driver 230 may change according to the flow of the frame.

As described above, the plurality of multiplexers 237 may be respectively controlled by the logic controller 232. The normal RGB image signal and the inversion RGB image signal may be output as they are, or the normal RGB image signal and the inversion RGB image signal may be output alternately.

As a result, the source driver 230 may operate in various inversion modes.

Figure 16:
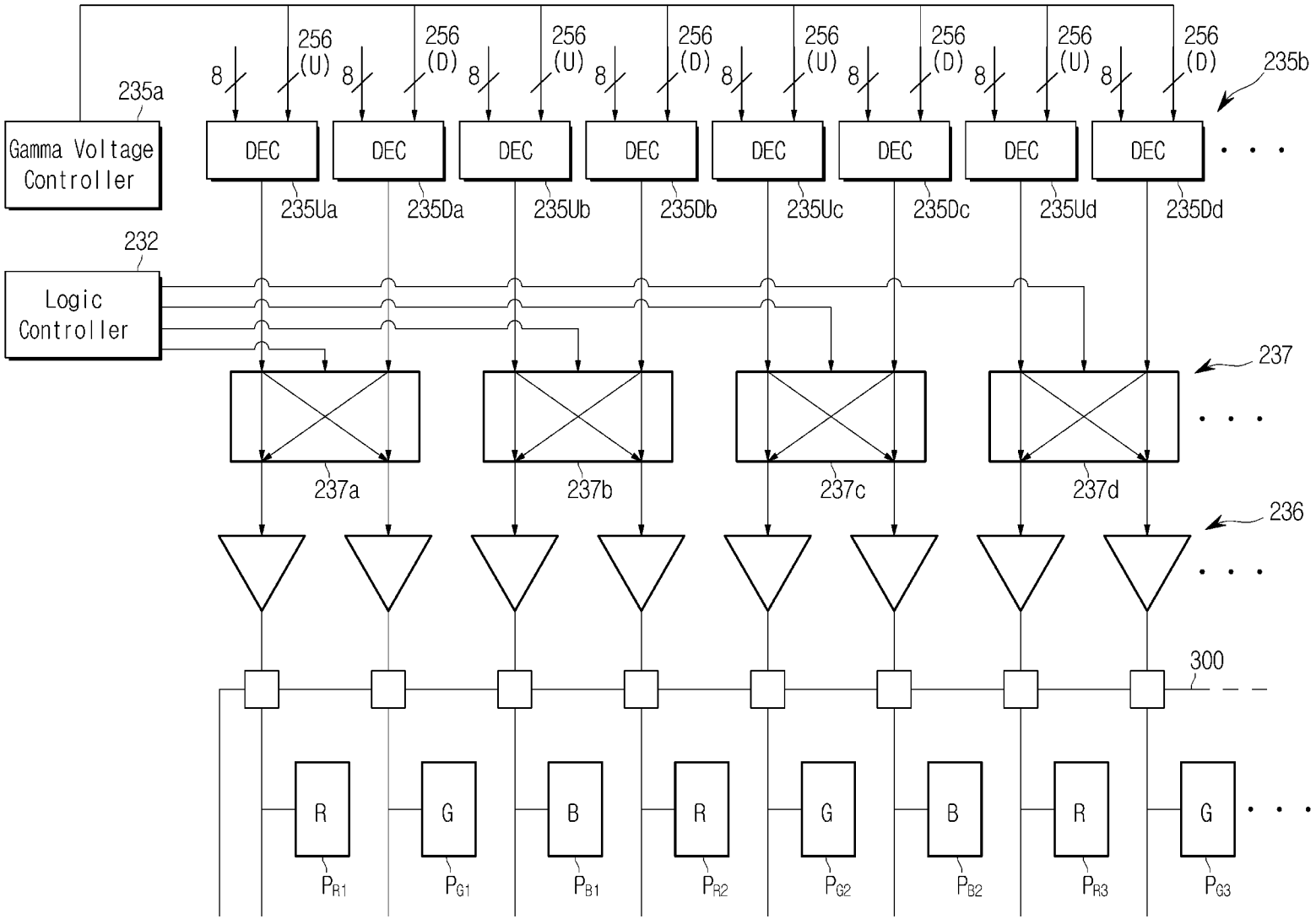
FIG. 16 is a view illustrating another example of a source driver and a display panel included in a display apparatus according to an embodiment.

FIG. 16 is a view illustrating another example of a source driver and a display panel included in a display apparatus according to an embodiment.

Referring to FIG. 16, the source driver 230 may include the logic controller 232, the DA converter 235, the plurality of multiplexers 237, and the plurality of output buffers 236.

The logic controller 232 may control the operation of the DA converter 235, the plurality of multiplexers 237, and the plurality of output buffers 236.

The DA converter 235 may convert the digital RGB image data into the analog RGB image signal, and may include the gamma voltage generator 235*a* for generating the reference voltage of the analog RGB image signal and the plurality of decoders 235*b* for decoding the digital RGB image data. The DA converter 235 may generate the normal analog RGB image signal and the inversion analog RGB image signal, and may output the normal analog RGB image signal and the inversion analog RGB image signal to the multiplexers 237.

The multiplexers 237 may directly output the normal analog RGB image signal and the inversion analog RGB image signal according to the inversion control signal of the logic controller 232, or may cross output the normal analog RGB image signal and the inversion analog RGB image signal.

In detail, the plurality of multiplexers 237 may output the normal analog RGB image signal and the inversion analog RGB image signal to the output buffers 236 as they are in response to the first control signal of the logic controller 232. In response to the second control signal of the logic controller 232, the normal analog RGB image signal and the inversion analog RGB image signal may be crossed and output to the output buffers 236.

The plurality of output buffers 236 may remove the noise of the analog RGB image signal output from the multiplexers 237 and amplify the current of the analog RGB image signal to supply the sufficient current to the display panel 300.

As such, compared to the source driver 230 illustrated in FIGS. 6 and 7, the source driver 230 illustrated in FIG. 16 may be disposed at an input terminal of the plurality of output buffers 236 of the multiplexers 237.

Meanwhile, the disclosed embodiments may be implemented in the form of a recording medium storing instructions that are executable by a computer. The instructions may be stored in the form of a program code, and when executed by a processor, the instructions may generate a program module to perform operations of the disclosed embodiments. The recording medium may be implemented as a computer-readable recording medium.

The computer-readable recording medium may include all kinds of recording media storing commands that can be interpreted by a computer. For example, the computer-readable recording medium may be ROM, RAM, a magnetic tape, a magnetic disc, flash memory, an optical data storage device, etc.

Embodiments and examples of the disclosure have thus far been described with reference to the accompanying drawings. It will be obvious to those of ordinary skill in the art that the disclosure may be practiced in other forms than the embodiments as described above without changing the technical idea or essential features of the disclosure. The above embodiments are only by way of example, and should not be interpreted in a limited sense.

What is claimed is:

1. A display apparatus comprising:

a liquid crystal panel; and a source driver configured to output an image signal to the liquid crystal panel, wherein the source driver comprises:

a digital-to-analog converter (DA converter) configured to convert digital image data into an image signal of normal polarity and an image signal of inversion polarity;

a plurality of multiplexers each of which receives the image signal of the normal polarity and the image signal of the inversion polarity from the DA converter, and outputs the image signal of the normal polarity and the image signal of the inversion polarity or cross outputs the image signal of the normal polarity and the image signal of the inversion polarity; and an inversion controller configured to output a control signal to each of the plurality of multiplexers through a plurality of output terminals respectively connected to the plurality of multiplexers, wherein each of the plurality of multiplexers is configured to receive one of a first control signal and a second control signal from the inversion controller independently of each other, and to output the image signal of the normal polarity and the image signal of the inversion polarity as they are in response to the first control signal of the inversion controller, and to cross output the image signal of the normal polarity and the image signal of the inversion polarity in response to the second control signal of the inversion controller.

2. The display apparatus according to claim 1, wherein the inversion controller is configured to output different output signals to each of the multiplexers in different inversion modes of the source driver.

3. The display apparatus according to claim 2, wherein the source driver is configured to operate in different inversion modes according to contents displayed on the liquid crystal panel.

4. The display apparatus according to claim 2, wherein the source driver is configured to operate in different inversion modes according to any one of the first control signal and the second control signal supplied from the inversion controller to each of the plurality of multiplexers.

5. The display apparatus according to claim 2, wherein the source driver is configured to operate in different inversion modes in a first frame and a second frame.

6. The display apparatus according to claim 1, further comprising:

a main controller configured to select an inversion mode according to contents displayed on the liquid crystal panel, wherein the inversion controller is configured to receive information about the selected inversion mode from the main controller, and to output any one of the first control signal and the second control signal to each of the plurality of multiplexers according to the information about the selected inversion mode.

7. The display apparatus according to claim 1, wherein the plurality of multiplexers comprises first, second, third, and fourth multiplexers, wherein the inversion controller is configured to output the first control signal to each of the first, second, third, and fourth multiplexers, and wherein the first, second, third, and fourth multiplexers are configured to output the image signal of the normal polarity and the image signal of the inversion polarity as they are.

8. The display apparatus according to claim 7, wherein the liquid crystal panel comprises first and second subpixels connected to the first multiplexer, third and fourth subpixels connected to the second multiplexer, fifth and sixth subpixels connected to the third multiplexer, and seventh and eighth subpixels connected to the fourth multiplexer, and wherein the first, third, fifth, and seventh subpixels are configured to receive the image signal of the normal polarity, and the second, fourth, sixth, and eighth subpixels are configured to receive the image signal of the inversion polarity.

9. The display apparatus according to claim 1, wherein the plurality of multiplexers comprise first, second, third, and fourth multiplexers, wherein the inversion controller is configured to output the first control signal to the first and third multiplexers, and to output the second control signal to the second and fourth multiplexers, and wherein the first and third multiplexers are each configured to output the image signal of the normal polarity and the image signal of the inversion polarity as they are, and the second and fourth multiplexers are each configured to cross output the image signal of the normal polarity and the image signal of the inversion polarity.

10. The display apparatus according to claim 9, wherein the liquid crystal panel comprises first and second subpixels connected to the first multiplexer, third and fourth subpixels connected to the second multiplexer, fifth and sixth subpixels connected to the third multiplexer, and seventh and eighth subpixels connected to the fourth multiplexer, and wherein the first, fourth, fifth, and eighth subpixels are configured to receive the image signal of the normal polarity, and the second, third, sixth, and seventh subpixels are configured to receive the image signal of the inversion polarity.

11. The display apparatus according to claim 1, wherein the plurality of multiplexers comprises first, second, third, and fourth multiplexers, wherein the inversion controller is configured to output the first control signal to the first and second multiplexers, and to output the second control signal to the third and fourth multiplexers, and wherein the first and second multiplexers are each configured to output the image signal of the normal polarity and the image signal of the inversion polarity, and the third and fourth multiplexers are each configured to cross output the image signal of the normal polarity and the image signal of the inversion polarity.

12. The display apparatus according to claim 11, wherein the liquid crystal panel comprises first and second subpixels connected to the first multiplexer, third and fourth subpixels connected to the second multiplexer, fifth and sixth subpixels connected to the third multiplexer, and seventh and eighth subpixels connected to the fourth multiplexer, and wherein the first, third, sixth, and eighth subpixels are configured to receive the image signal of the normal polarity, and the second, fourth, fifth, and seventh subpixels are configured to receive the image signal of the inversion polarity.

13. The display apparatus according to claim 1, wherein the plurality of multiplexers comprise first, second, third, and fourth multiplexers, wherein the inversion controller is configured to output the first control signal to the first and fourth multiplexers, and to output the second control signal to the second and third multiplexers, and wherein the first and fourth multiplexers are configured to output the image signal of the normal polarity and the image signal of the inversion polarity, and the second and third multiplexers are configured to cross output the image signal of the normal polarity and the image signal of the inversion polarity.

14. The display apparatus according to claim 13, wherein the liquid crystal panel comprises first and second subpixels connected to the first multiplexer, third and fourth subpixels connected to the second multiplexer, fifth and sixth subpixels connected to the third multiplexer, and seventh and eighth subpixels connected to the fourth multiplexer, and wherein the first, fourth, sixth, and seventh subpixels are configured to receive the image signal of the normal polarity, and the second, third, fifth, and eighth subpixels are configured to receive the image signal of the inversion polarity.

* * * * *